US010292480B2

(12) United States Patent
Facer et al.

(10) Patent No.: US 10,292,480 B2
(45) Date of Patent: May 21, 2019

(54) BOTTLE ASSEMBLY

(71) Applicant: SNUGZ/USA INCORPORATED, West Jordan, UT (US)

(72) Inventors: C. Michael Facer, Syracuse, UT (US); Cade Andersen, Kaysville, UT (US)

(73) Assignee: SNUGZ/USA INCORPORATED, West Jordan, UT (US)

( * ) Notice: Subject to any disclaimer, the term of this patent is extended or adjusted under 35 U.S.C. 154(b) by 128 days.

(21) Appl. No.: 15/374,151

(22) Filed: Dec. 9, 2016

(65) Prior Publication Data

US 2017/0095054 A1 Apr. 6, 2017

Related U.S. Application Data

(63) Continuation-in-part of application No. 14/727,288, filed on Jun. 1, 2015, now abandoned, which is a (Continued)

(51) Int. Cl.

| | |
|---|---|
| ***A61J 7/04*** | (2006.01) |
| ***A45D 34/06*** | (2006.01) |
| ***B65D 23/12*** | (2006.01) |
| ***A45F 5/02*** | (2006.01) |
| ***A45D 34/00*** | (2006.01) |
| ***A45D 40/24*** | (2006.01) |

(52) U.S. Cl.

CPC ..... *A45D 34/06* (2013.01); *A45D 34/00* (2013.01); *A45D 40/24* (2013.01); *A45F 5/02* (2013.01); *A45F 5/021* (2013.01); *B65D 23/12* (2013.01); *A45D 2034/002* (2013.01); *A45D 2034/007* (2013.01); *A45D 2200/25* (2013.01)

(58) Field of Classification Search

CPC .... A45D 34/00; A45D 34/06; A45D 2200/25; A45D 2034/002; A45D 2034/007; A45D 40/24; B65D 23/12; B65D 43/02; B65D 1/0223; B65D 21/0237; A45F 5/02; A45F 5/021

USPC ..... 29/453; 206/216, 581; 220/23.4, 23.86, 220/737, 735, 694; 215/6, 386, 499

See application file for complete search history.

(56) References Cited

U.S. PATENT DOCUMENTS

| | | | |
|---|---|---|---|
| 251,566 | A | 12/1881 | Fuller |
| D100,412 | S | 7/1936 | Carp |

(Continued)

OTHER PUBLICATIONS

Pdf images from snugz.com, "2oz Duo Bottle with Clear Gel Sanitizer and SPF 15 Lip Balm in White Tube," published, on information and belief, at least as early as Oct. 3, 2015, archived in archive.org (3 pages).

(Continued)

*Primary Examiner* — Fenn C Mathew
*Assistant Examiner* — Elizabeth J Volz
(74) *Attorney, Agent, or Firm* — Workman Nydegger

(57) ABSTRACT

A bottle assembly comprises a bottle having an end wall having a substantially U-shaped compartment for receiving a lip balm container and a coupling assembly for removably grasping the lip balm container as the lip balm container rests within the substantially U-shaped compartment, the coupling assembly removably coupling the lip balm container to the bottle. The coupling assembly can be configured to be mounted onto a top surface of the bottle and can have a connecting ring thereon for coupling to a carabiner.

19 Claims, 30 Drawing Sheets

Related U.S. Application Data continuation-in-part of application No. 29/498,657, filed on Aug. 6, 2014, now Pat. No. Des. 762,485.

(56) References Cited

U.S. PATENT DOCUMENTS

| | | | | |
|---|---|---|---|---|
| 2,744,649 | A | 5/1956 | Chandler | |
| D325,341 | S | 4/1992 | Balavich | |
| D325,342 | S | 4/1992 | Balavich | |
| 5,316,398 | A * | 5/1994 | Chandaria | B65D 21/0237 132/297 |
| D372,671 | S | 8/1996 | Bossert | |
| D507,174 | S | 7/2005 | Katz | |
| D591,167 | S | 4/2009 | Kyster | |
| D635,799 | S | 4/2011 | Snider | |
| D762,485 | S | 8/2016 | Facer et al. | |
| 2003/0111496 | A1 * | 6/2003 | Abbott | F16B 45/02 224/148.6 |
| 2015/0108016 | A1 * | 4/2015 | Horn | A61J 1/00 206/232 |
| 2016/0037892 | A1 | 2/2016 | Facer et al. | |

OTHER PUBLICATIONS snugzusa.com website pages, published Nov. 23, 2016 (2 pages).
Photographs of Snugz USA Duo Bottle on sale and sold (with cap and containing liquid and with container containing lip balm), on information and belief, at least as early as Nov. 2015; 10 photographs (10 pages).
U.S. Appl. No. 29/498,657, dated Jan. 15, 2016, Restriction Requirement.
U.S. Appl. No. 29/498,657, dated Mar. 23, 2016, Notice of Allowance.
U.S. Appl. No. 29/498,657, dated Jul. 13, 2016, Issue Notification.
U.S. Appl. No. 14/727,288, dated Apr. 19, 2016, Office Action.
U.S. Appl. No. 14/727,288, dated Dec. 30, 2016, Final Office Action.

* cited by examiner

BOTTLE ASSEMBLY

CROSS-REFERENCE TO RELATED APPLICATIONS

This nonprovisional patent application is a continuation-in-part of U.S. patent application Ser. No. 14/727,288 dated Jun. 1, 2015 entitled BOTTLE ASSEMBLY, which is a continuation-in-part of U.S. design patent application Ser. No. 29/498,657, filed on Aug. 6, 2014, entitled BOTTLE ASSEMBLY, to Facer, et al, each of which are incorporated herein in its entirety by reference.

BACKGROUND OF THE INVENTION

1. The Field of the Invention

This invention is in the fields of: (i) sunscreen containers; and (ii) lip balm containers.

2. The Relevant Technology

This invention relates to sunscreen containers and lip balm containers and materials used and produced in connection with the protection of an individual's skin and lips from the adverse effects of the sun. For centuries, people have struggled with the ability to be outside while at the same time preserving their skin and health from the damaging effects of the sun. It is common to use sunscreen to protect the user's skin and to use lip balm to protect a user's lips. However, these products are typically sold separately and users often forget one or the other. Users might remember to bring sunscreen, but may often forget to bring lip balm when going outdoors, or vice versa. There is therefore a need in the art for a convenient way to purchase, store, ship and use sunscreen and lip balm simultaneously.

BRIEF SUMMARY OF THE INVENTION

An example of a bottle assembly of the present invention comprises a bottle having an end wall having a compartment for receiving a lip balm container and a coupling assembly for removably grasping the lip balm container as the lip balm container rests within the substantially U-shaped compartment. The coupling assembly removably couples the lip balm container to the bottle. The coupling assembly may be comprised of a plastic material, for example, that has sufficient resilience such that (i) the coupling assembly has sufficient flexibility that the lip balm container can be placed within the substantially U-shaped compartment by being pressed into the coupling assembly, which maintains the lip balm container within the substantially U-shaped compartment in the absence of a removing force; and such that (ii) the coupling assembly has sufficient flexibility such that the coupling assembly releases the lip balm container when a force is generated pulling the lip balm container out of the coupling assembly and out of the substantially U-shaped compartment.

An embodiment of the bottle assembly comprises a bottle having a recessed end wall having a substantially U-shaped compartment for receiving a lip balm container and a coupling assembly for removably grasping the lip balm container as the lip balm container rests on a rounded protuberance within the substantially U-shaped compartment, the coupling assembly removably coupling the lip balm container to the bottle.

Another embodiment of the bottle assembly comprises: (i) a bottle; (ii) a lip balm container, the bottle having a recessed end wall having an L-shaped compartment for receiving lip balm container; and (iii) a coupling assembly for removably grasping lip balm container as lip balm container rests on a semi-circular protuberance within the L-shaped compartment.

In one such embodiment, the coupling assembly also provides a upper ledge which is useful because it serves to maintain an upper partial lid on lip balm container in the upright position and as a lower ledge upon which lip balm container partially rests in the inverted position. The ledge acts in both positions to maintain the container coupled to the bottle.

The coupling assembly further has a connecting ring mounted on the body of coupling assembly for selectively receiving a carabiner therethrough for connection to a belt loop, zipper, glove, or other object. By including a connecting ring within the coupling assembly, the Bottle Assembly is able to have a connecting ring in a manner that is convenient for manufacturing and there is no need to pierce a hole through the body of the bottle, which can be an expensive process in manufacturing.

Thus, in one embodiment, the grasping assembly thus acts both as an upper ledge and as a grasping member to hold an elongate container such as a lip balm container therein. The ledge also completes the U-shaped compartment into which the lip balm container is selectively placed and the grasping assembly also provides a connecting ring for receiving a carabiner.

Thus, by combing the connecting ring, gripping latches, and ledge all within a coupling assembly, many advantages and functions are achieved in a single part, i.e., the coupling assembly, which is conveniently mounted onto the bottle during the manufacturing process. The coupling assembly is thus highly advantageous, useful, and novel.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
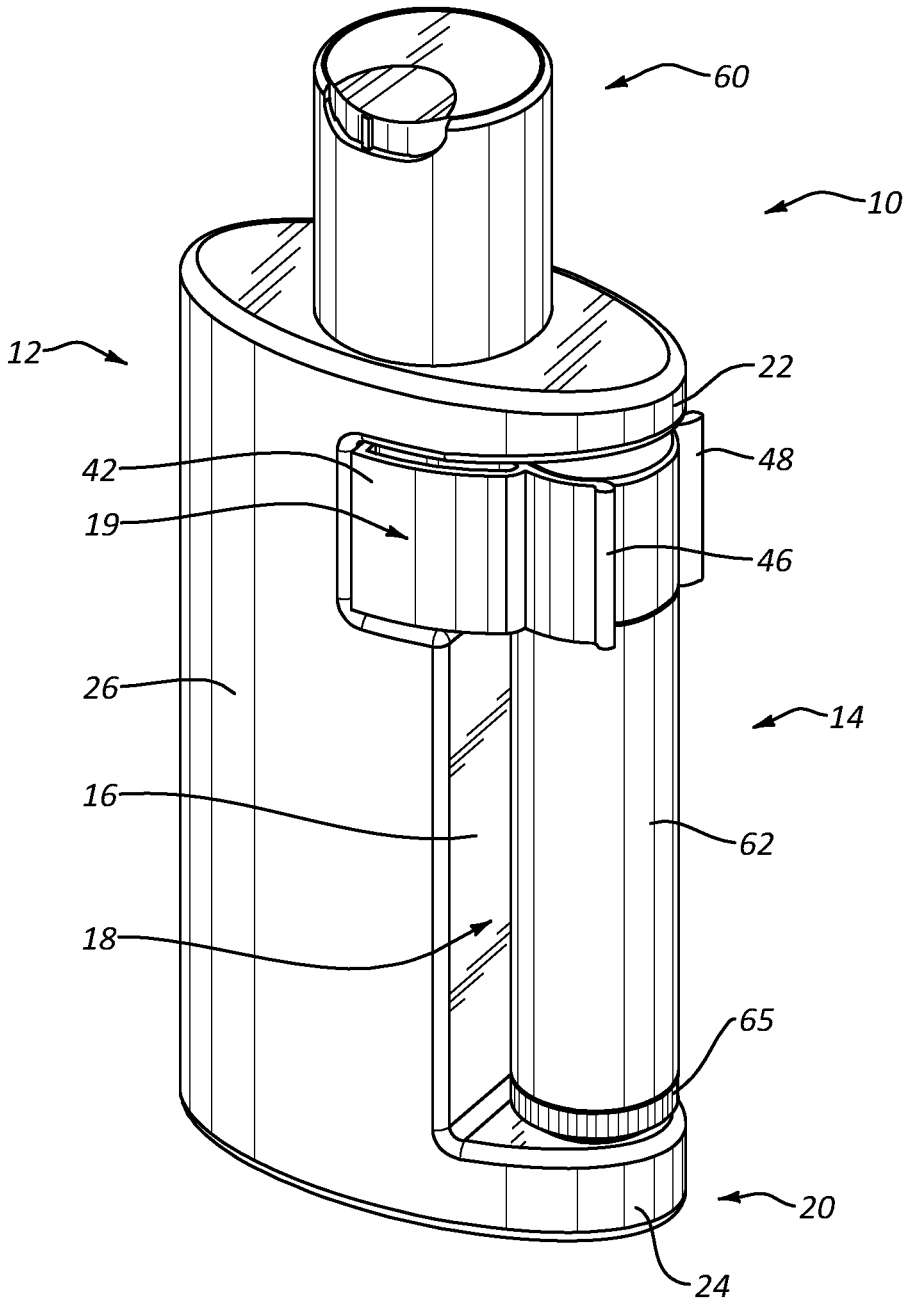
FIG. 1 is a top perspective view of a Bottle Assembly of the present invention for convenient storage of both liquid and lip balm materials without co-mingling the materials.

As shown in FIG. 1, a bottle assembly 10 of the present invention comprises a bottle 12 and a lip balm container 14, the bottle 12 having a recessed end wall 16 having a substantially U-shaped compartment 18 for receiving lip balm container 14 and a coupling assembly 19 for removably grasping lip balm container 14 as lip balm container 14 rests on a rounded protuberance 66 (see FIG. 9) within the substantially U-shaped compartment 18. Coupling assembly 19 removably couples lip balm container 14 to bottle 12. Coupling assembly 19 may be comprised of a plastic material, for example, that has sufficient flexibility and resilience such that (i) lip balm container 14 can be placed within substantially U-shaped compartment 18 by being pressed into the coupling assembly 19, which maintains lip balm container 14 within substantially U-shaped compartment 18 in the absence of a removing force; and such that (ii) coupling assembly 19 has sufficient flexibility such that the coupling assembly 19 releases lip balm container 14 when a force is generated pulling lip balm container 14 out of coupling assembly 19 and out of substantially U-shaped compartment 18.

Bottle 12 has a bottle body 26 having, on at least one side thereof, as shown in FIG. 1, an upper ledge 22 and a lower ledge 24 that extend outwardly from the bottle body 26 laterally so as to form substantially U-shaped compartment 18. Upper ledge 22 has a lower surface 30 (FIG. 2) and lower ledge 20 has an upper surface 32 (FIG. 3) between which the lip balm container 14 is mounted within substantially U-shaped compartment 18. Upper ledge 22 is connected to lower ledge 24 by recessed end wall 16, forming substantially U-shaped compartment 18.

Figure 2:
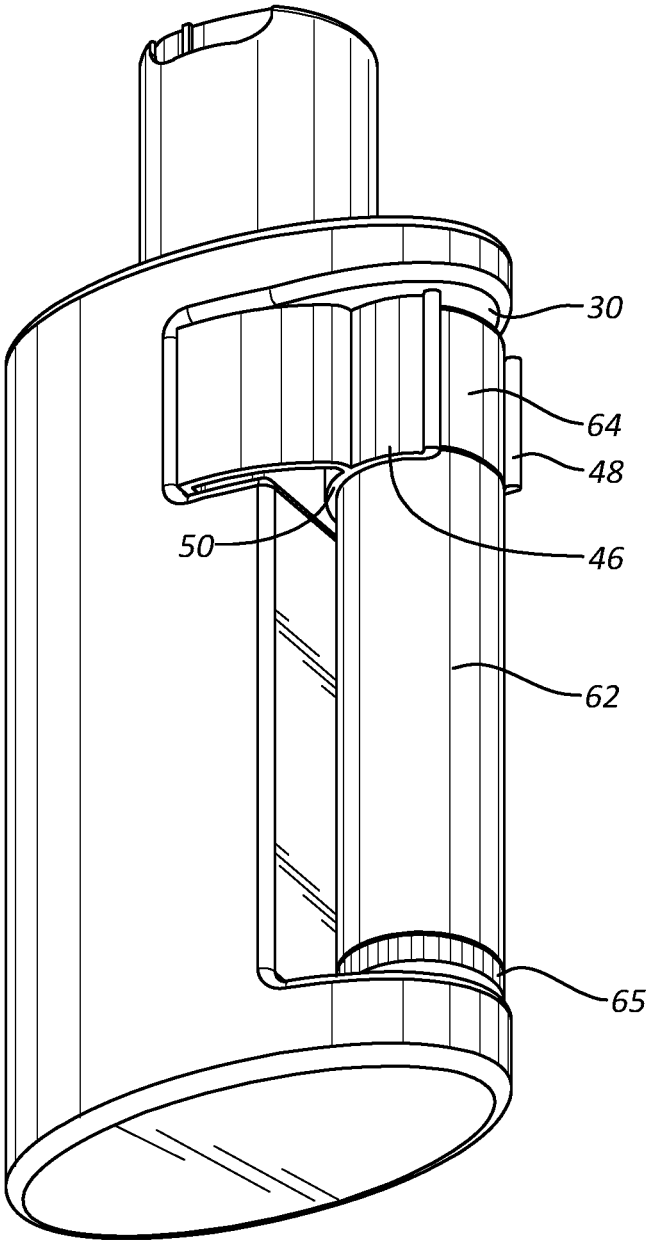
FIG. 2 is a bottom perspective view of the Bottle Assembly of FIG. 1.
Figure 6:
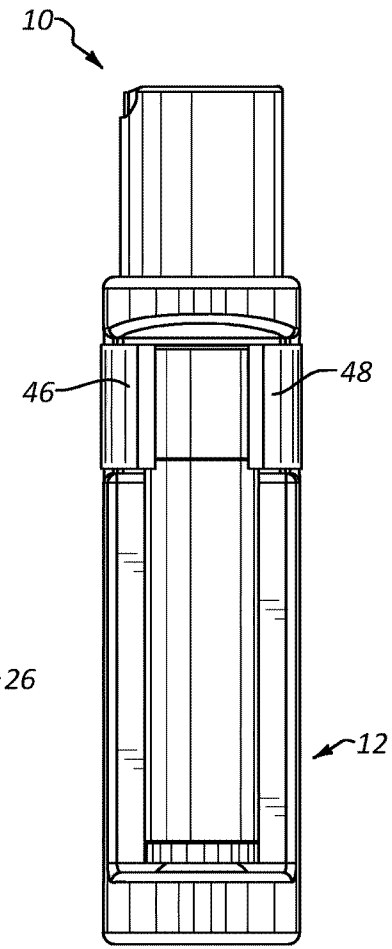
FIGS. 5-6 are back and front views, respectively of the Bottle Assembly of FIG. 1.
Figure 5:
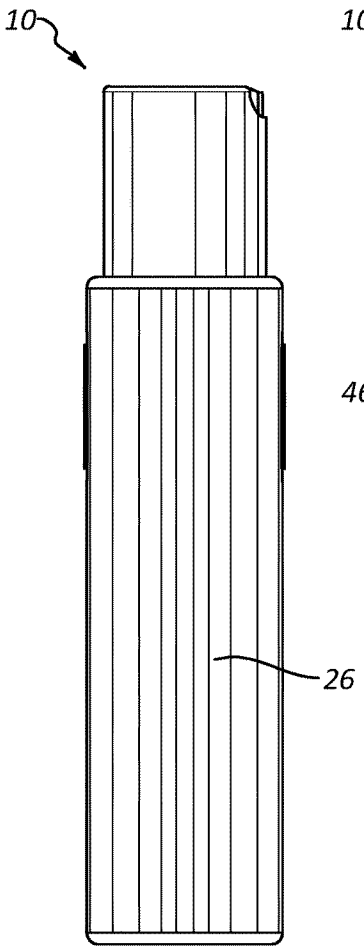
Figure 4:
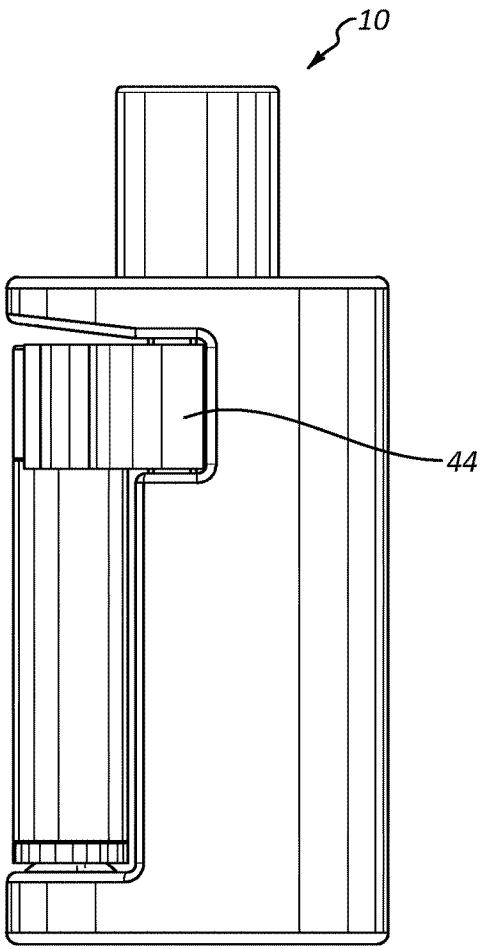
FIGS. 3-4 are right and left side views, respectively of the Bottle Assembly of FIG. 1.
Figure 3:
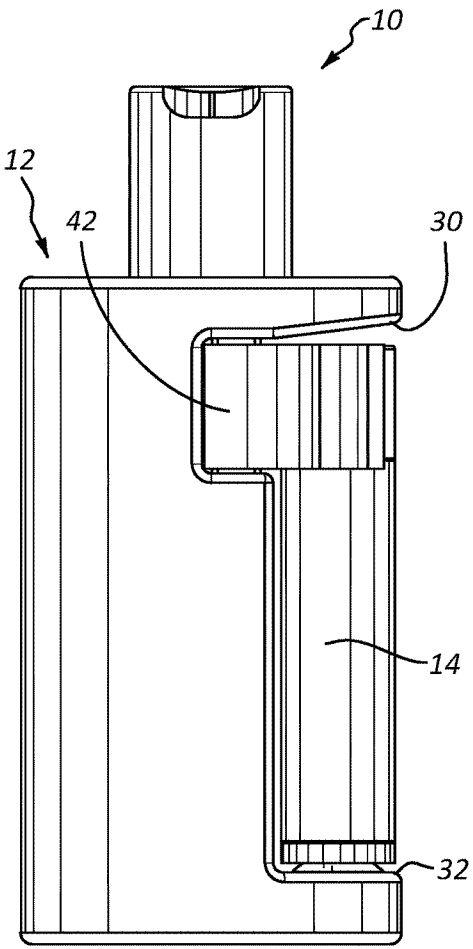

As further shown in FIGS. 1-2 and in FIGS. 9-12, connected to bottle body 26 is coupling assembly 19. Coupling assembly 19, which can be a separate piece or can be integrally formed with body 26, comprises (i) first and second proximal latches 42, 44 (FIG. 4) which connect to curved body 50 (FIG. 2) of coupling assembly 19 and which connect to bottle body 26, and (ii) first and second distal latches 46, 48 which connect to curved body 50 of coupling assembly 19 and which are resiliently movable with respect to body 50 of coupling assembly such that the lip balm container 14 can be selectively, removably mounted within distal latches 46, 48 of assembly 19 to thereby removably maintain lip balm container 14 within assembly 19 while lip balm container 14 rests within compartment 18 on the lower ledge 24 of body 26 (e.g., on protuberance 66 of ledge 24).

Coupling assembly 19 thus selectively, removably maintains container 14 within the compartment 18 of bottle 12 for convenient accessibility. Since container 14 is removably connected to bottle 12, it is convenient to purchase, store, ship, and use assembly 10 as a unit. Users are much less likely to forget their sunscreen and/or lip balm because they are in a single assembly, as shown in FIG. 1. Bottle 12 may be a plastic bottle which contains a sunscreen having an spf selected from a variety of different spfs, for example. Container 14 is an elongate container which may be one of a variety of different types of lip balm containers, such as a CHAPSTICK lip balm container, for example.

Figure 9:
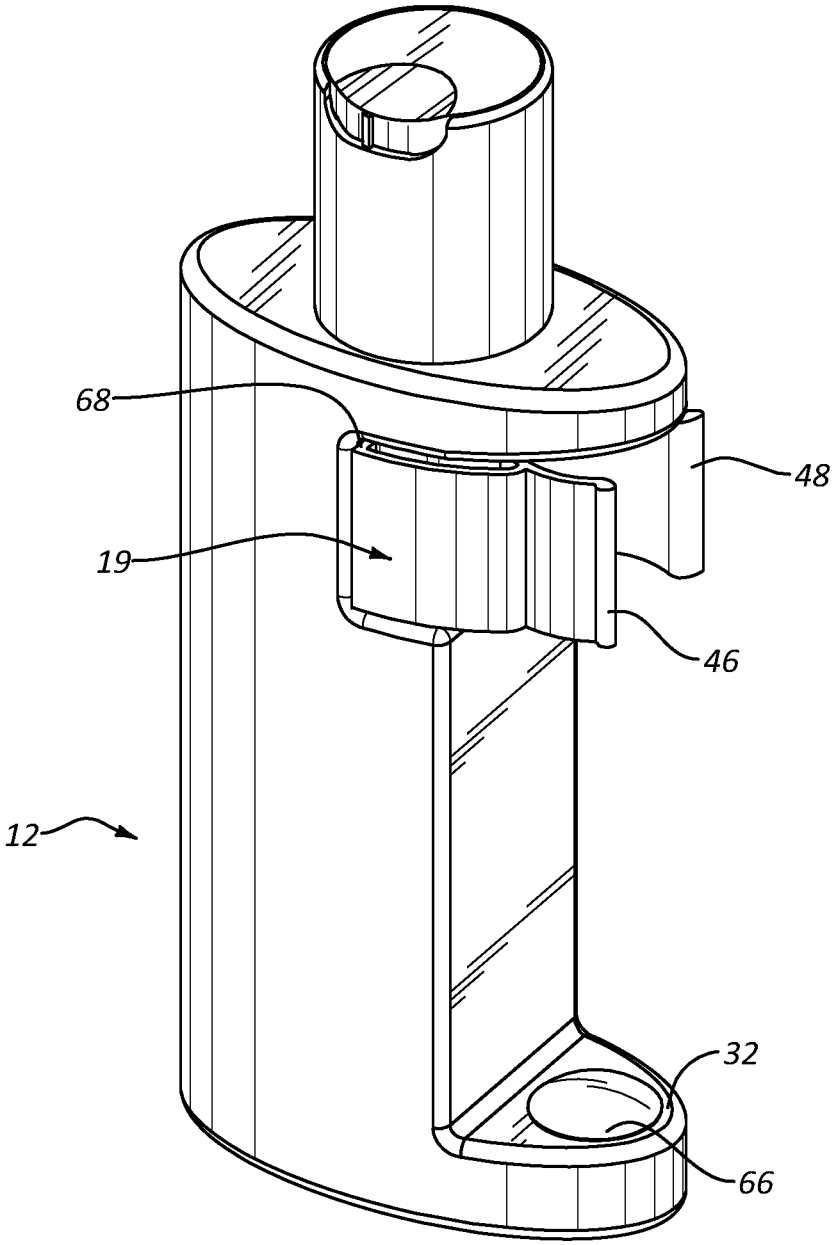
FIGS. 9 and 10 are top and bottom perspective views, respectively, of the bottle of the Bottle Assembly of FIGS. 1-8 without the lip balm container.
Figure 10:
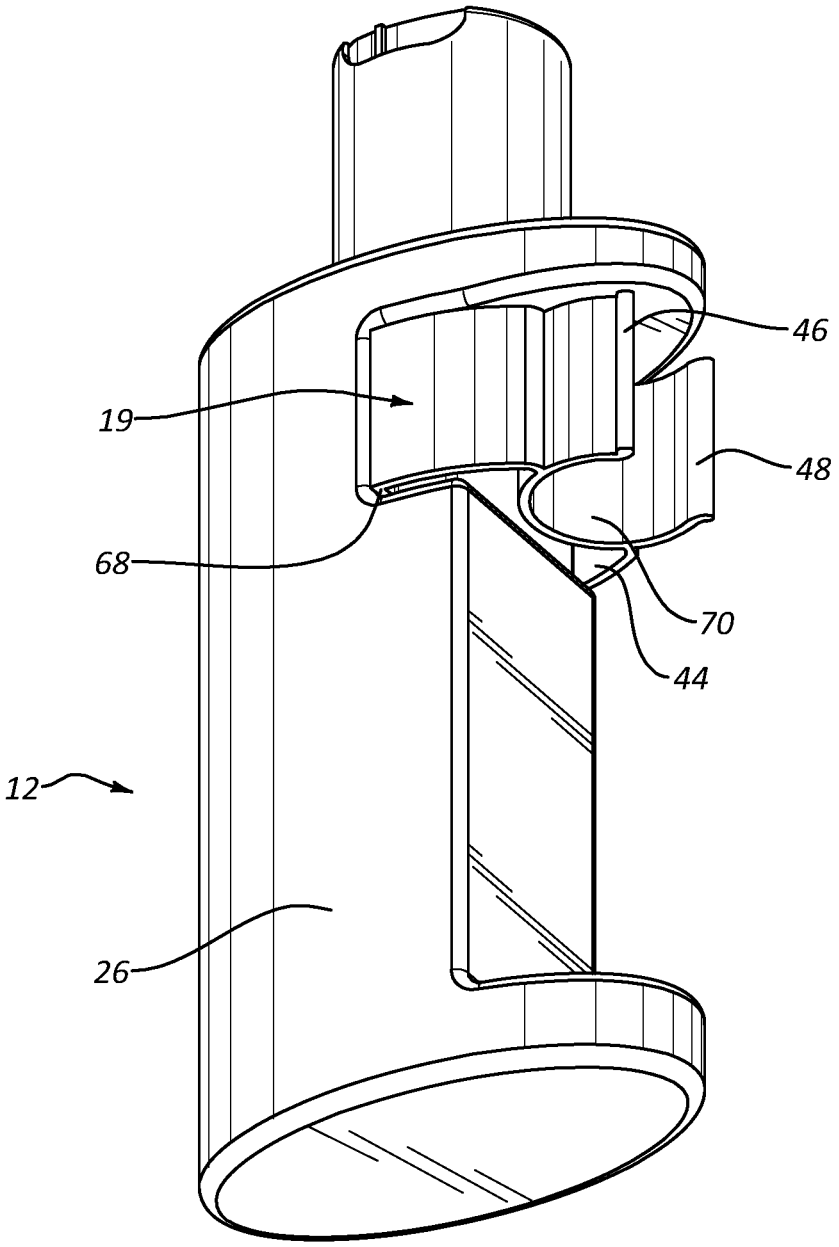
Figure 11:
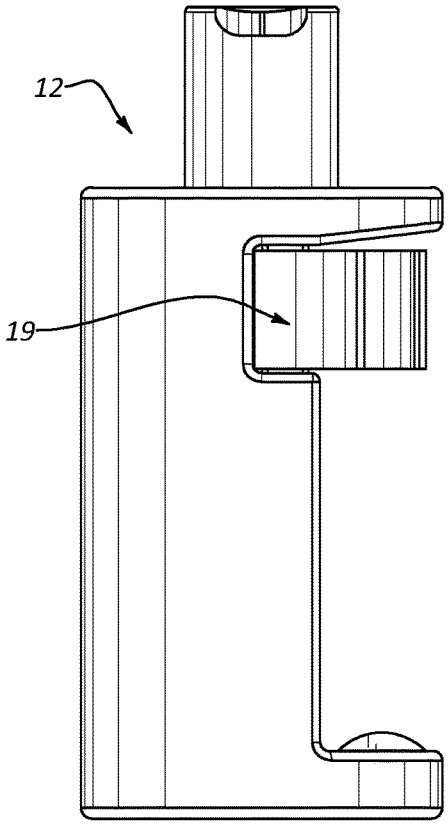
FIGS. 11-12 are right and left side views, respectively of the bottle of FIGS. 9-10.
Figure 12:
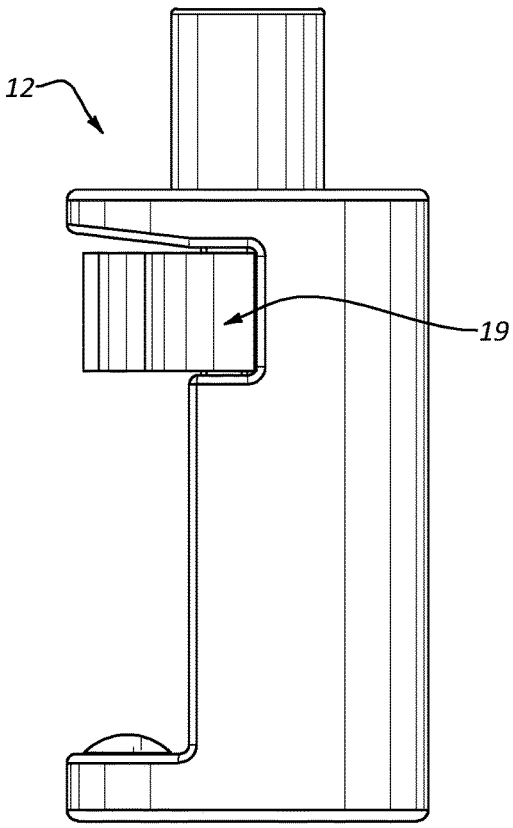
Figure 13:
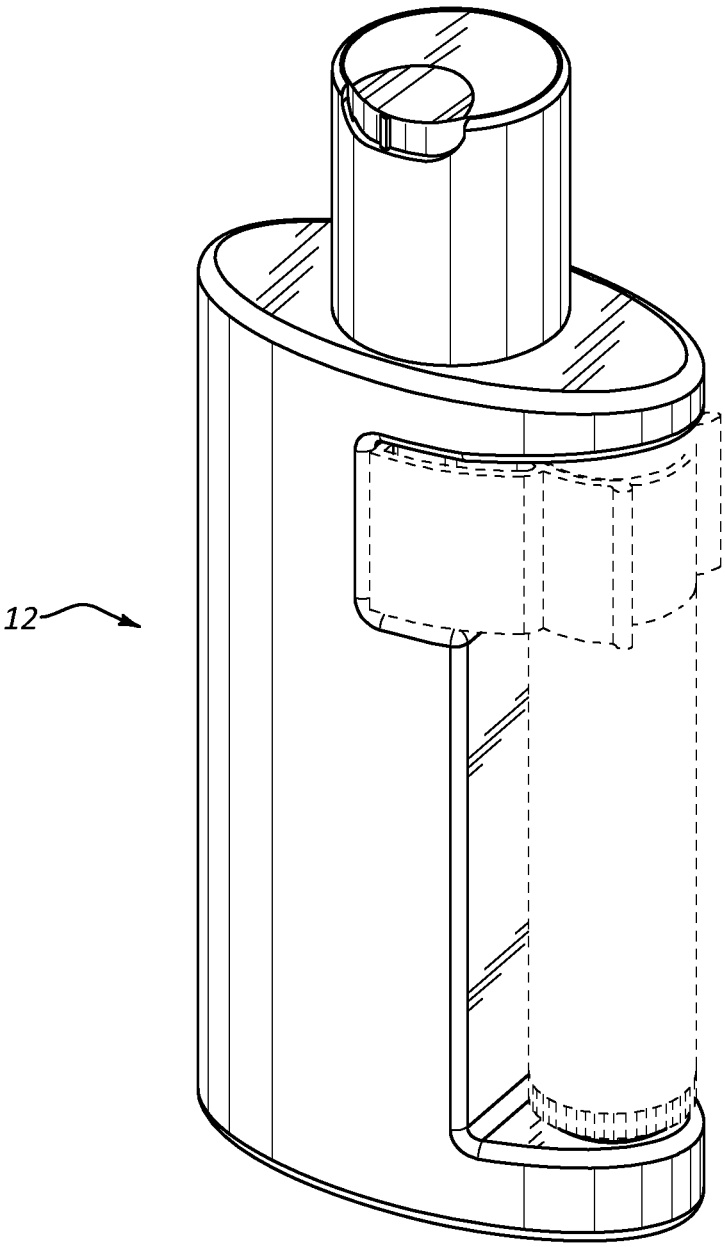
FIGS. 13-14 are top and bottom perspective views of the Bottle Assembly of FIGS. 1-8 of the present invention with the coupling assembly and lip balm container shown in broken, phantom lines.
Figure 14:
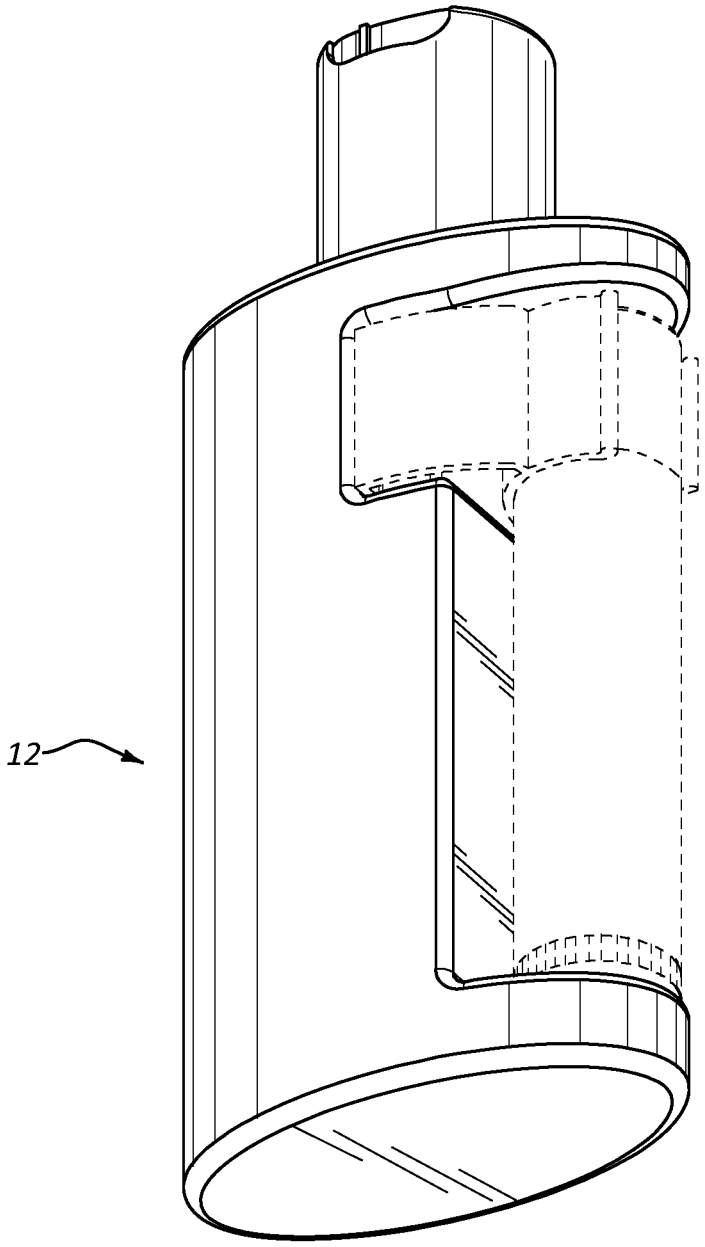

Bottle assembly 10 further comprises a cap 60 mounted on bottle 12 for releasably maintaining a liquid such as sunscreen within bottle 12. Lip balm container 14 comprises lip balm container body 62 and lip balm container cap 64 and a rotating lip balm container adjustment device 65 for adjustably moving the lip balm within container body 62. Elongate lip balm container 14 contains a lip balm or other medicinal or soothing material therein. Body 62 of elongate container 14 may have a concave lower surface configured to receive protuberance 66 therein to assist with maintaining lip balm container within compartment 18 when an upper portion of lip balm container 14 is removably mounted within coupling assembly 19, as shown in FIG. 1. As shown in FIG. 9, the lower ledge 32 of the assembly 10 includes rounded, convex protuberance 66 extending upwardly from the ledge 32.

As further shown in FIG. 9, the resiliently movable clasping latches 46, 48 of coupling assembly 19 are available for a lip balm container 14 to be removably placed therebetween, such that the clasping latches 46, 48 will temporarily move apart as the lip balm container is placed there between, but then will resiliently maintain lip balm container 14 therebetween when lip balm container 14 is placed on the rounded protuberance 66 and between ledges 22 and 24. Container 14 may then be selectively removed from latches 46, 48.

Coupling assembly 19 may be a single molded plastic piece that snaps onto opposing sides of body 26 of bottle 12 (e.g., a plastic bottle 12) with opposing first and second latching ears 68 (FIG. 9) that extend from respective proximal latches 42, 44 into mating grooves within opposing sides of bottle body 26.

Coupling assembly 19 is comprised of a curved body 50 from which distal curved latches 46, 48 extend outwardly with sufficient resilient deformability so they can be moved apart to receive lip balm container 14 therein, yet with sufficient resilience that they will move back into place once the lip balm container 14 is grasped between latches 46, 48. Latches 46, 48 can then be moved apart again when container is pulled away from latches 46, 48.

In use, the user conveniently mounts the lip balm container 14 onto protuberance 66 of ledge 24 when it is desired to place the lip balm container 14 within bottle 12 and further snaps lip balm container between curved latches 46, 48 of coupling assembly 19 and into curved body 50. In this position, the lip balm container and the sunscreen or other liquid in bottle 12 can be conveniently moved, stored and maintained in a singular assembly, such that the user will have both at the user's ready disposal when needed and such that the user will not need to remember to obtain separate lip balm and sunscreen in distinct locations when needed.

When the user desires to use sunscreen, the user can maintain both in an assembly and apply the sunscreen by opening the lid of cap 60, or by removing cap 60, and dispensing sunscreen from bottle 12. When the user desires to apply lip balm, the user can remove lip balm container 14 from the grasp of curved latches 46, 48 and readily apply the lip balm from container 14, then return the lip balm container 14 to the position shown in FIG. 1.

Figure 7:
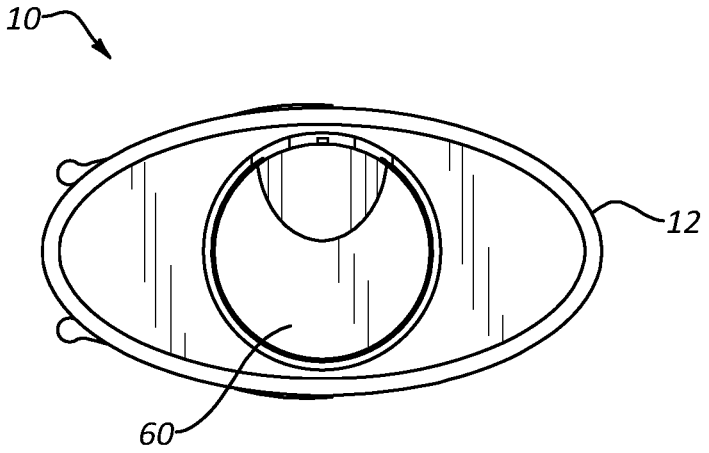
FIGS. 7-8 are top and bottom views, respectively of the Bottle Assembly of FIG. 1.
Figure 8:
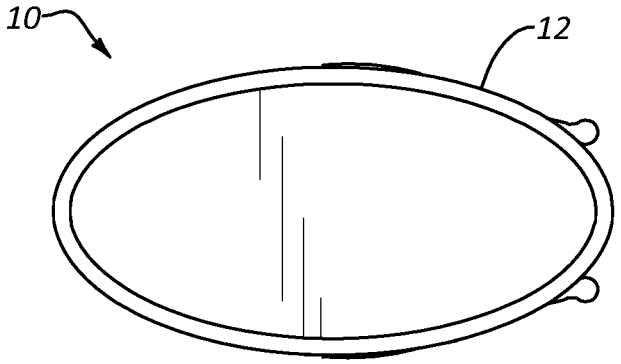

As shown in FIGS. 1 and 7-8, lip balm container 14 is configured to fit within the outer wall of bottle 12 such that container 14 substantially fits within the horizontal footprint of the bottle 12. By fitting within the horizontal footprint of bottle 12, as shown in FIGS. 7-8, lip balm container 14 efficiently uses space within the profile of bottle 12. Assembly is thus a convenient bottle assembly for storing a liquid material and a balm material in separate portions of the assembly 10 for convenient storage of the materials without co-mingling the materials.

As shown in FIGS. 15-18*b*, yet another embodiment of a Bottle Assembly 210 of the present invention comprises: (i) a bottle 212; (ii) a lip balm container 214, the bottle 212 having a recessed end wall 216 having an L-shaped compartment 218 for receiving lip balm container 214; and (iii) a coupling assembly 219 for removably grasping lip balm container 214 as lip balm container 214 rests on a substantially semi-circular protuberance 266 (or optionally a rounded or circular protuberance) within the L-shaped compartment 218 of bottle 212.

Bottle 212 has a bottle body 226 having, on at least one side thereof, a lower ledge 230 edge that extends outwardly from the bottle body 226 laterally to form the L-shaped compartment 218.

Coupling assembly 219 provides a upper ledge 224, which protrudes over the L-shaped channel 218 and which is integrally connected to the upper panel 220 of coupling assembly 219. Upper panel 220 is integrally connected to downwardly extending side panels 242*a-b* of coupling assembly 219. Thus, coupling assembly 219 is useful because it provides both gripping capability and ledge 224 which serves to maintain an upper partial lid on lip balm container 214 in the upright position of FIGS. 15-16. Ledge 224 also serves as a lower ledge upon which lip balm container 214 partially rests in the inverted position of FIG. 17, rather than allowing container 214 to fall downwardly away from bottle 212 while in the inverted position. Ledge 224 thus acts as a partial lid in the upright position of FIGS. 15-16 and as a partial floor in the inverted position of FIG. 17, ledge 224 acting in both positions to maintain container 214 coupled to bottle 12. Also, ledge 224 and L-shaped compartment 218 of bottle 212 collectively form a substantially U-shaped compartment that houses container 214.

Figure 15:
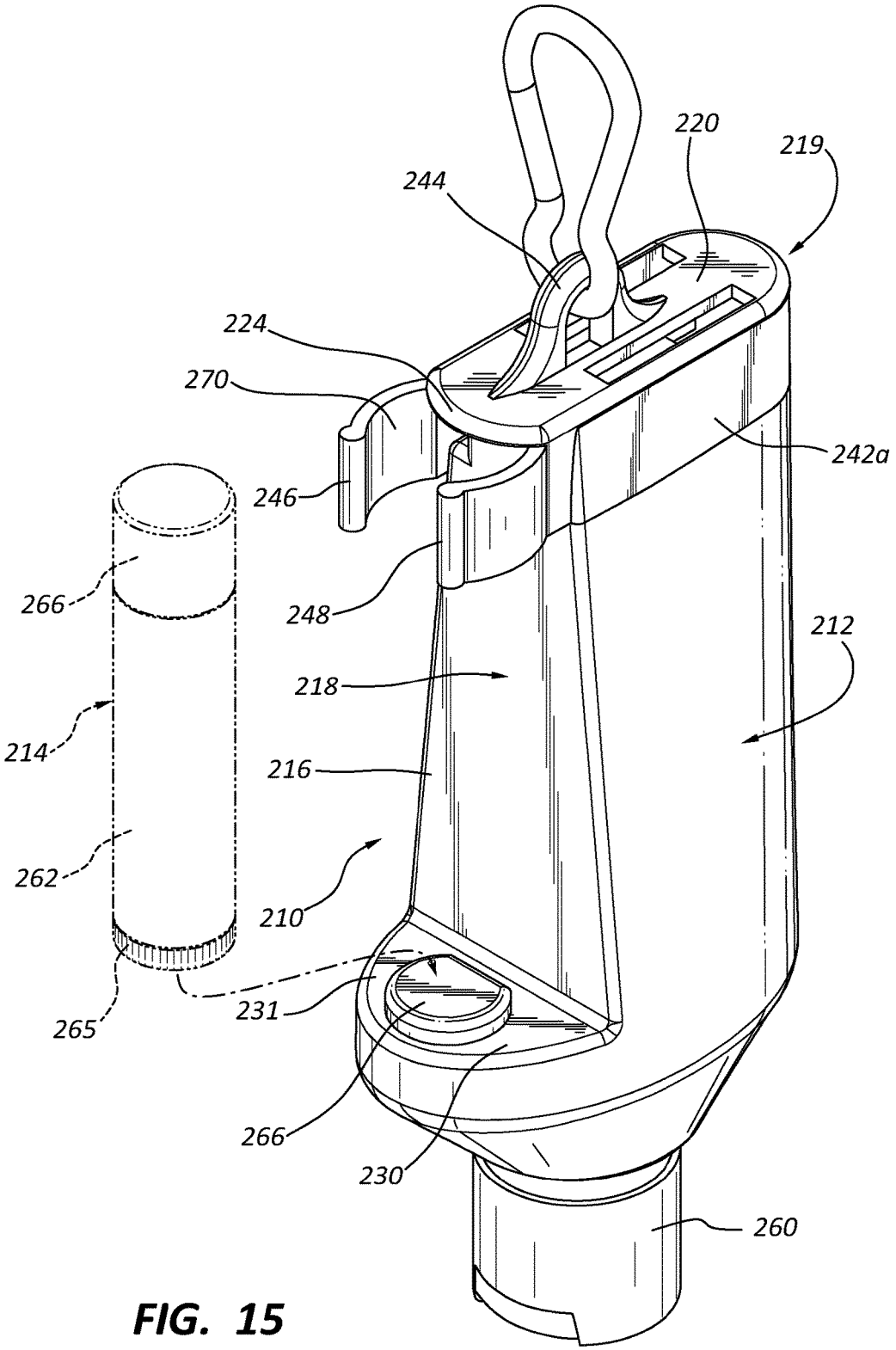
FIG. 15 is a top perspective view of another embodiment of a bottle assembly of the present invention for convenient storage of both liquid and lip balm materials without co-mingling the materials; the lip balm container is shown in broken, phantom lines

Coupling assembly 219 further has a connecting ring 244, or other connecting member, mounted on the substantially planar panel 220 of coupling assembly 219. Connecting ring 244 selectively receives a carabiner, as illustrated in FIG. 15, or other clipping mechanism for connection to a belt loop, zipper, glove, or other object. By including connecting ring 244 within coupling assembly 219, the Bottle Assembly 210 is able to have a connecting ring in a manner that is convenient for manufacturing. For example, there is no need to pierce or mold a hole through bottle 212, which can be an expensive process in manufacturing, in order to provide a connecting ring onto which a carabiner or other clipping mechanism can be clipped.

The grasping assembly 219 thus acts as a ledge 224, as a grasping member to hold an elongate container such as a lip balm container therein, and also provides a ring 244 for a clipping mechanism. The ledge 224 completes the substantially U- shaped compartment for receiving a lip balm container therein.

By combing the connecting ring 244, gripping latches 246-248, and ledge 224 all within coupling assembly 219, many advantages and functions are achieved in a single part, i.e., assembly 219, which is conveniently mounted onto bottle 212 during the manufacturing process. The connecting ring of the present invention can be any member, such as ring 244, that is mounted on panel 220 of assembly and that has an aperture therethrough such that a carabiner or other clipping mechanism can be mounted thereon.

The conveniently mounted coupling assembly 219 includes gripping latches 246-248 which grasp container 214 in one direction, ledge 224 which borders and contains container 214 in another direction, and connecting ring 244 which connects to a carabiner for connecting the Bottle Assembly 210 to a belt loop or other object. Coupling Assembly 219 is thus highly advantageous, useful and novel.

Grasping assembly 219 is conveniently mounted on the top edge of bottle 212 during assembly, leaving printing space in the middle and bottom portion of the bottle 212. Coupling assembly 219 is mounted on bottle 212 during assembly. More specifically, in one embodiment, during assembly of Bottle Assembly 210, coupling assembly 219 is mounted onto the upper end 232 of bottle 212, as reflected in FIG. 16, by pulling the side panels 242*a-b* (FIGS. 18A-B) of coupling assembly 219 apart, then allowing the elongate inner ridges 250-*a-b* on the inner surfaces of the respective panels 242*a-b* snap into respective channels 243*a-b* of the bottle 212. The mounting of assembly 219 on the top edge of bottle body 226 within bottle channels 243*a-b* leaves extensive space for logos and other marketing indicia in the middle and lower portions of body 226 of bottle 212.

Since coupling assembly 219 includes both gripping capability through curved distal latches 246-248, partial ceiling/floor capability through ledge 224, a connecting ring 244 for coupling to a carabiner, all within a convenient assembly coupled to the top of the bottle 12 away from the center portion of bottle 212, coupling assembly 219 is advantageous from a number of perspectives.

Coupling assembly 219 comprises a substantially planar elongate panel 220 and first and second elongate side panels 242*a-b* which extend downwardly from top panel 220 and which have respective ridges 250*a-b* thereon which fit within respective elongate internal channels 243*a-b* in respective side walls of body 226 of bottle 212 during assembly. Ledge 224 of assembly is the terminal edge of the panel 220 of coupling assembly 219 on one end of panel 220, ledge 224 extending partially over ledge 230 of bottle 212.

Figure 16:
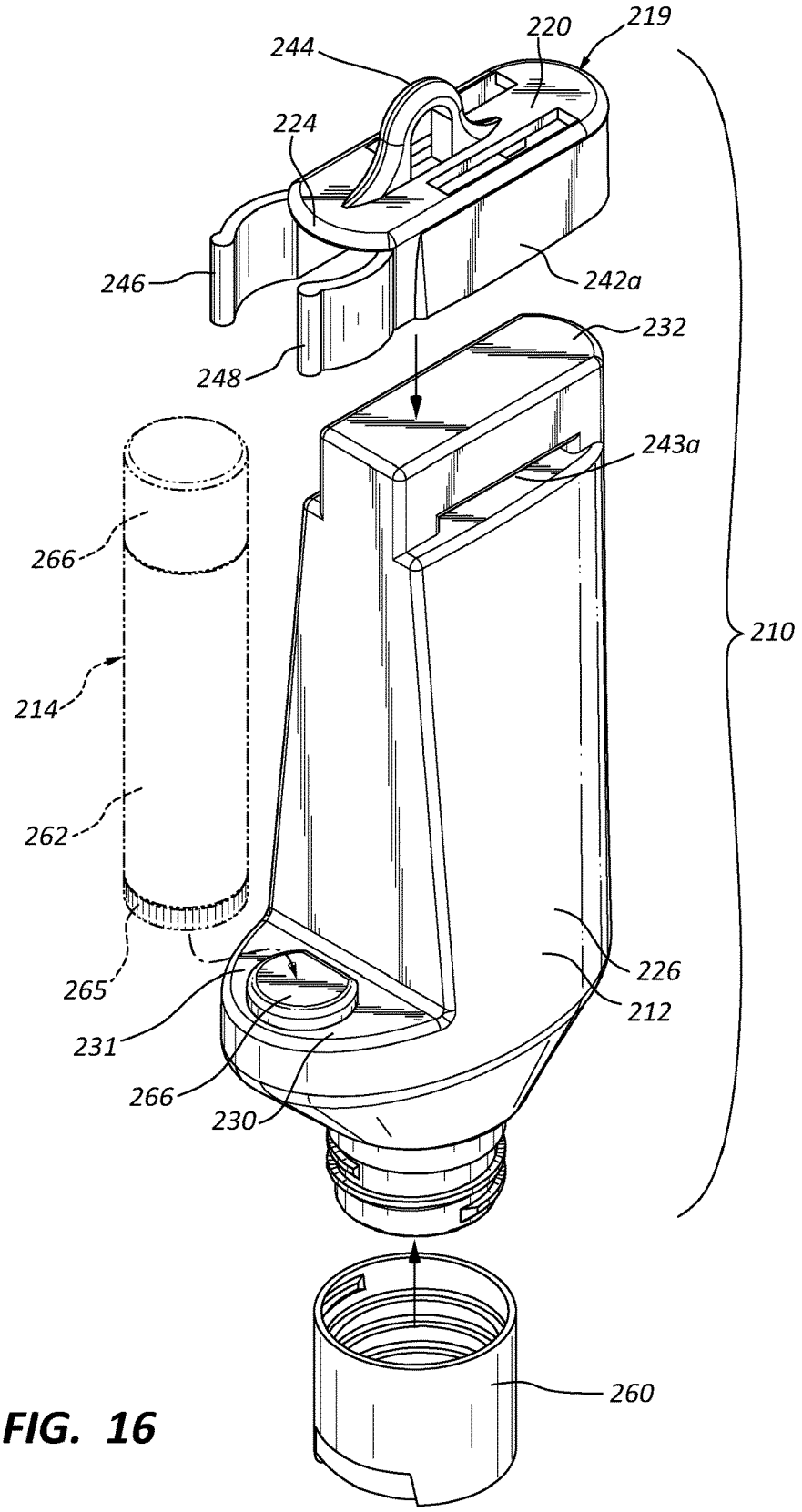
FIG. 16 is an exploded perspective view of the Bottle Assembly of FIG. 15.
Figure 17:
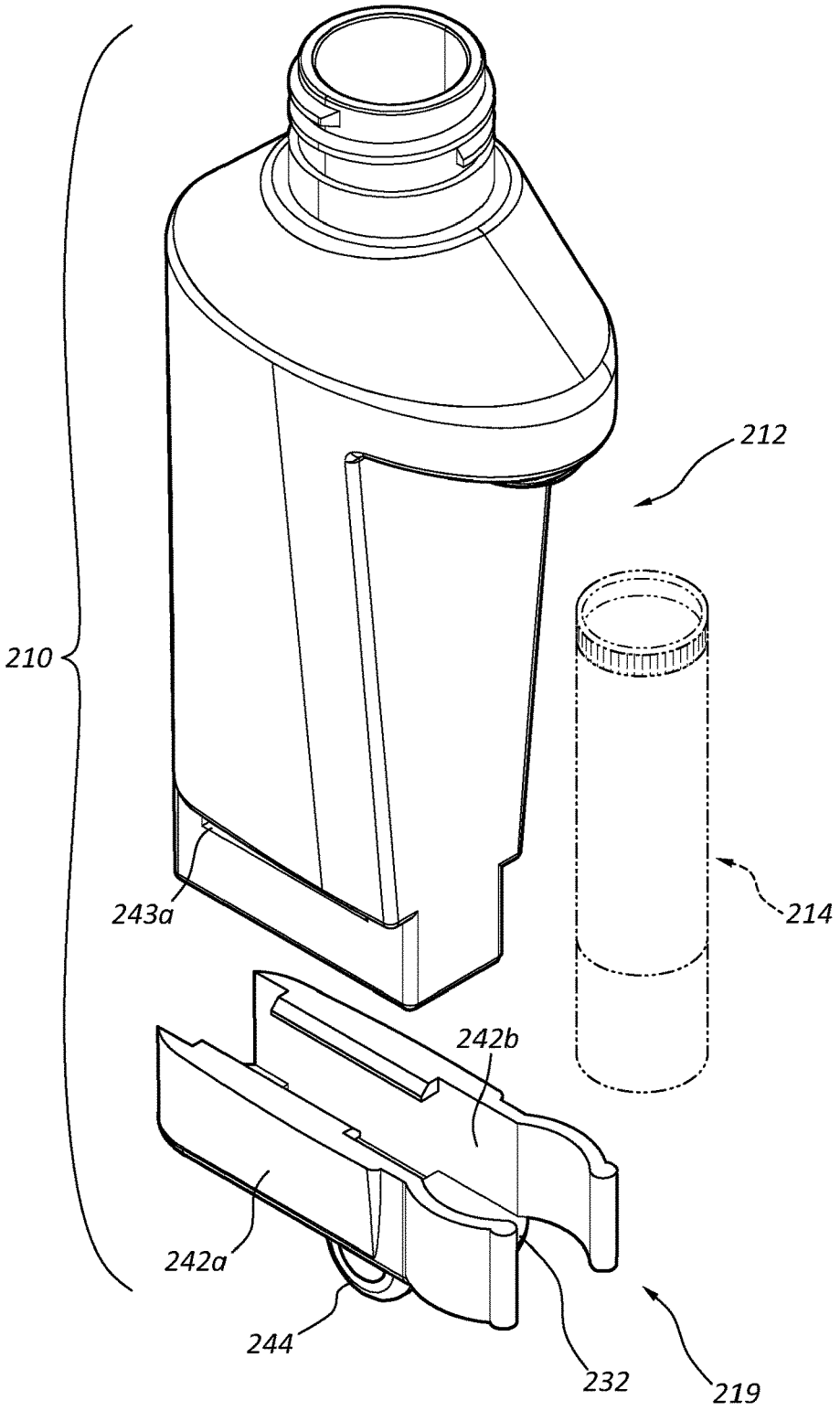
FIG. 17 is an exploded view of the bottle and coupling assembly of the Bottle Assembly of FIG. 15.
Figure 18A:
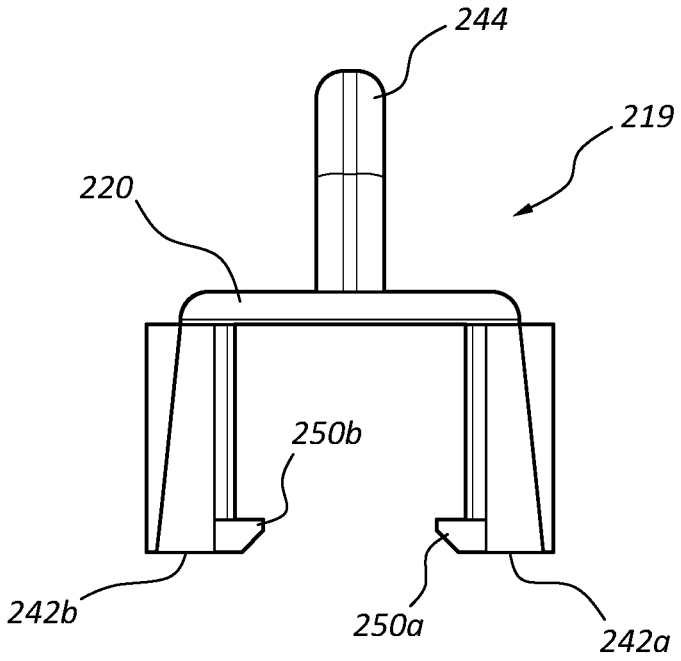
FIGS. 18A and 18B are front and back views, respectively, of the coupling assembly of the Bottle Assembly of FIG. 15.
Figure 18B:
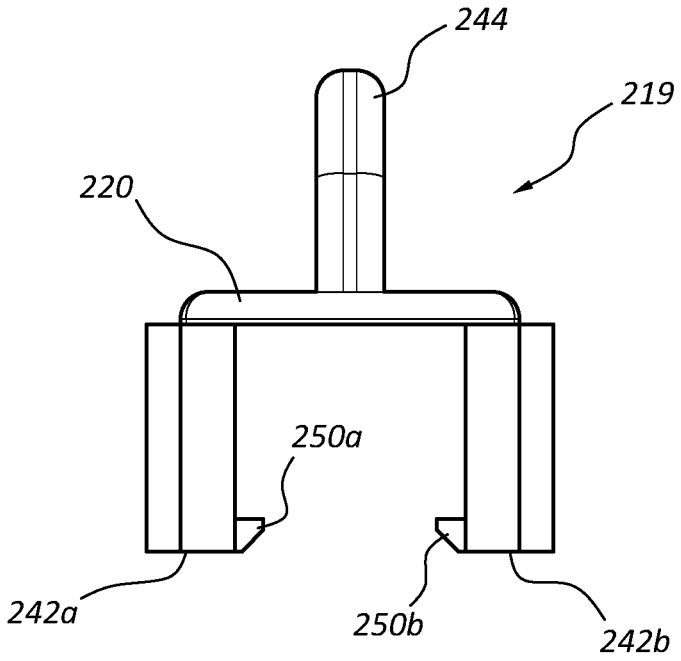

When assembly 219 is mounted on bottle 212, as shown in FIGS. 15-17, the ledge 224 of coupling assembly 219 and the laterally-extending ledge 230 of bottle 212 form a substantially U-shaped compartment. The substantially U-shaped compartment is formed by the ledge 230 of bottle 212, the ledge 224 of assembly 219 and the recessed end wall 216 of bottle body 226. As shown in FIG. 15, the lower ledge 230 of bottle body 226 has an upper facing surface and ledge 224 of assembly 219 has a lower facing surface 232 between which the lip balm container 214 is mounted within substantially U-shaped compartment adjacent the end wall 216 of the substantially U-shaped compartment.

Coupling assembly 219, which is mounted on the upper end of bottle 212 removably couples lip balm container 214 to bottle 212. Curved distal gripping latches 246, 248 extend from opposing panels 242*b*-242*a* of coupling assembly 219 to thereby removably maintain lip balm container 214 within assembly 219 while lip balm container 214 rests within compartment 218 on the lower ledge 230 of body 226 (e.g., on protuberance 266 of ledge 230).

Coupling assembly 219 may be comprised of a plastic material, for example, that has sufficient flexibility and resilience such that (i) lip balm container 214 can be placed within compartment 218 by being pressed into the coupling assembly 219, which maintains lip balm container 214 within compartment 218 in the absence of a removing force; and such that (ii) coupling assembly 219 has sufficient flexibility such that the coupling assembly 219 releases lip balm container 214 when a force is generated pulling lip balm container 214 out of coupling assembly 219 and out of compartment 218. Bottle 212 may also be comprised of a plastic material. Thus, in one embodiment, both bottle 212 and coupling assembly 219 are comprised of plastic.

Coupling assembly 219 thus selectively, removably maintains container 214 within the compartment 218 of bottle 212 for convenient accessibility. Since container 214 is removably connected to bottle 212, it is convenient to purchase, store, ship, and use assembly 210 as a unit. Users are much less likely to forget their sunscreen and/or lip balm because they are in a single assembly. Bottle 212 may be a plastic bottle which contains a sunscreen having an spf selected from a variety of different spfs, for example. Container 214 is an elongate container which may be one of a variety of different types of lip balm containers, such as a CHAPSTICK lip balm container, for example.

Figure 19A:
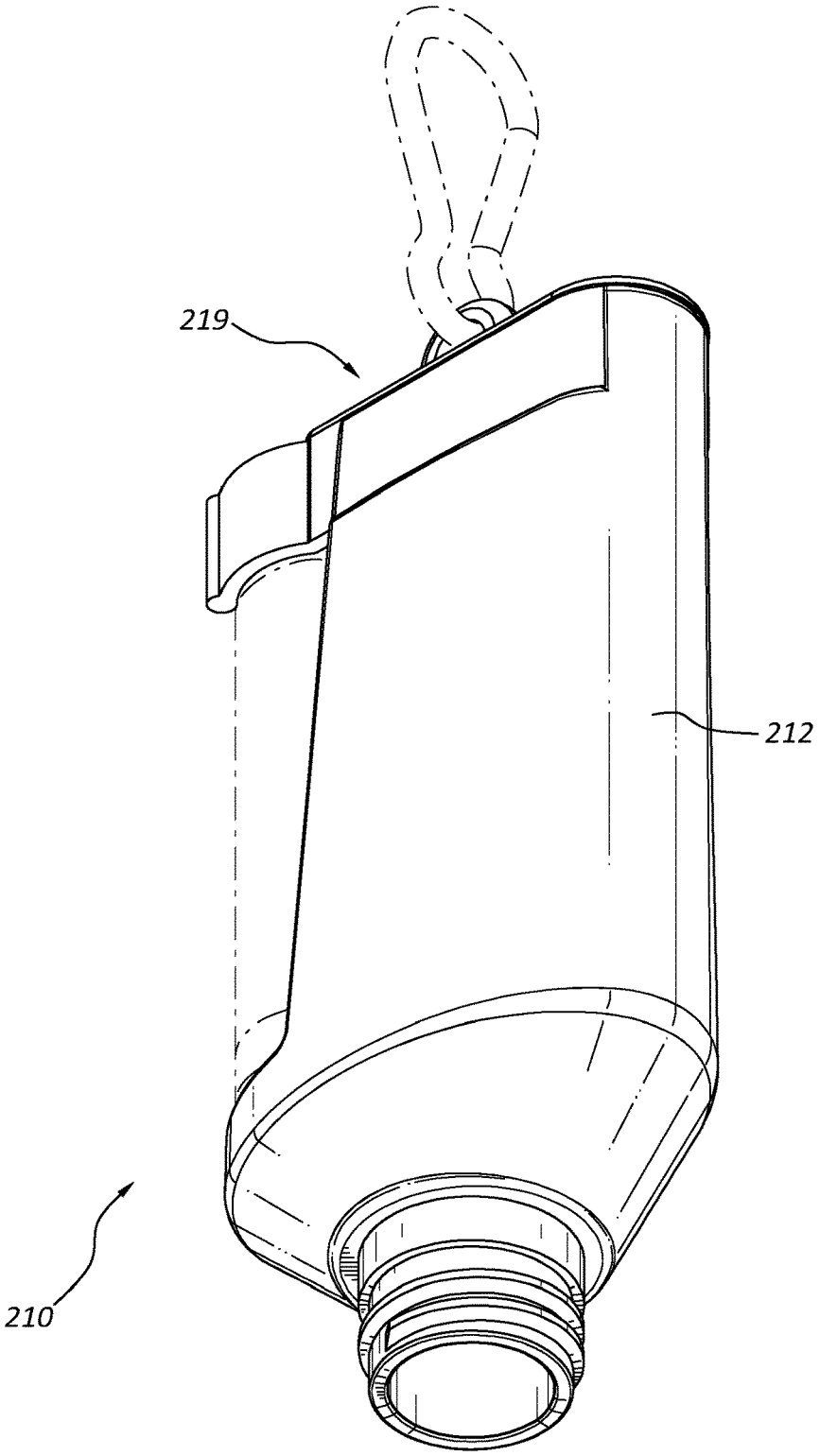
FIGS. 19A is a perspective view of the Bottle Assembly of FIG. 15 without the lid of the bottle; the lip balm container is shown in broken, phantom lines.
Figure 19B:
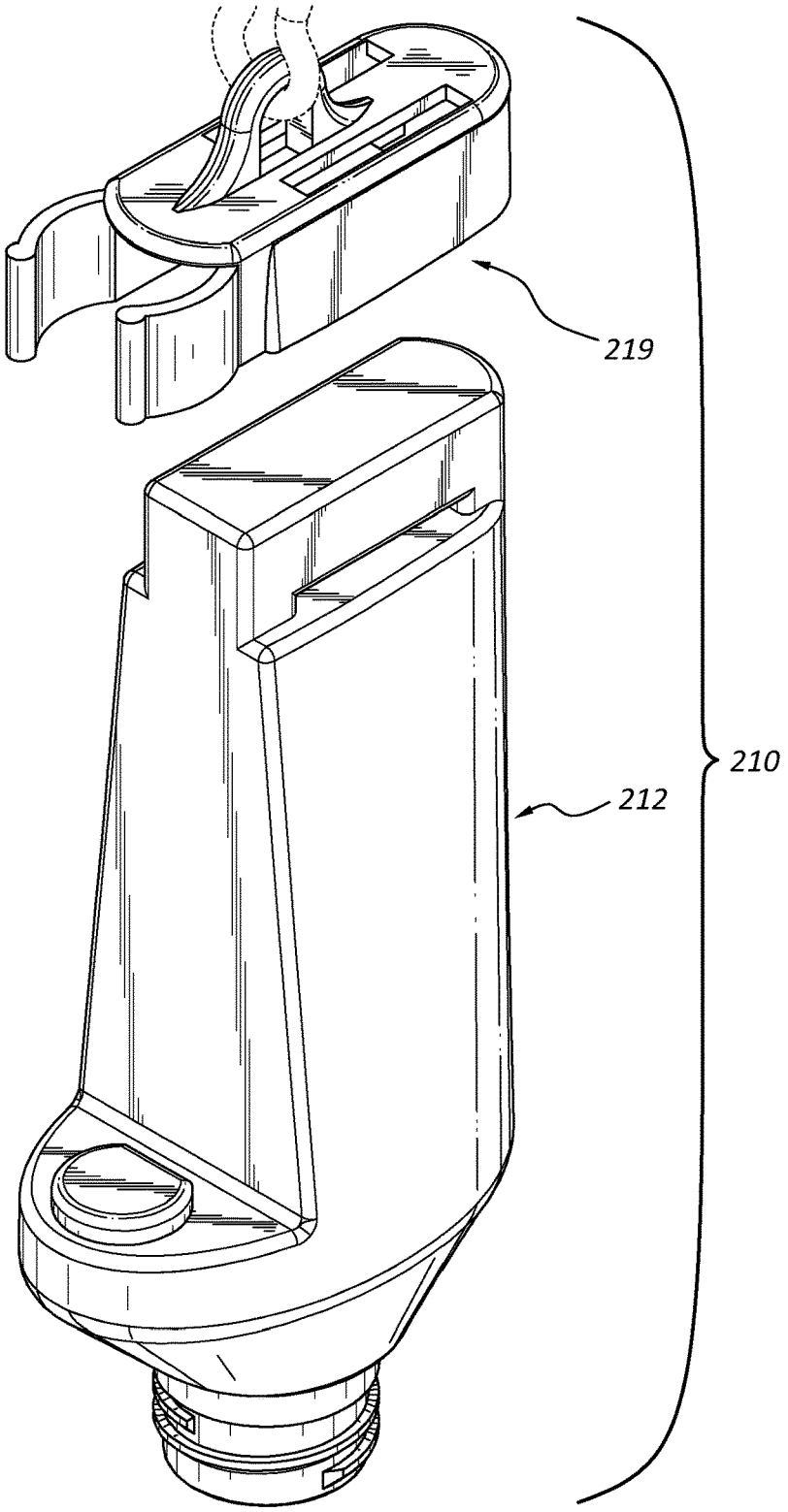
FIGS. 19B is a perspective exploded view of the bottle and coupling assembly of the Bottle Assembly of FIG. 15.
Figure 20:
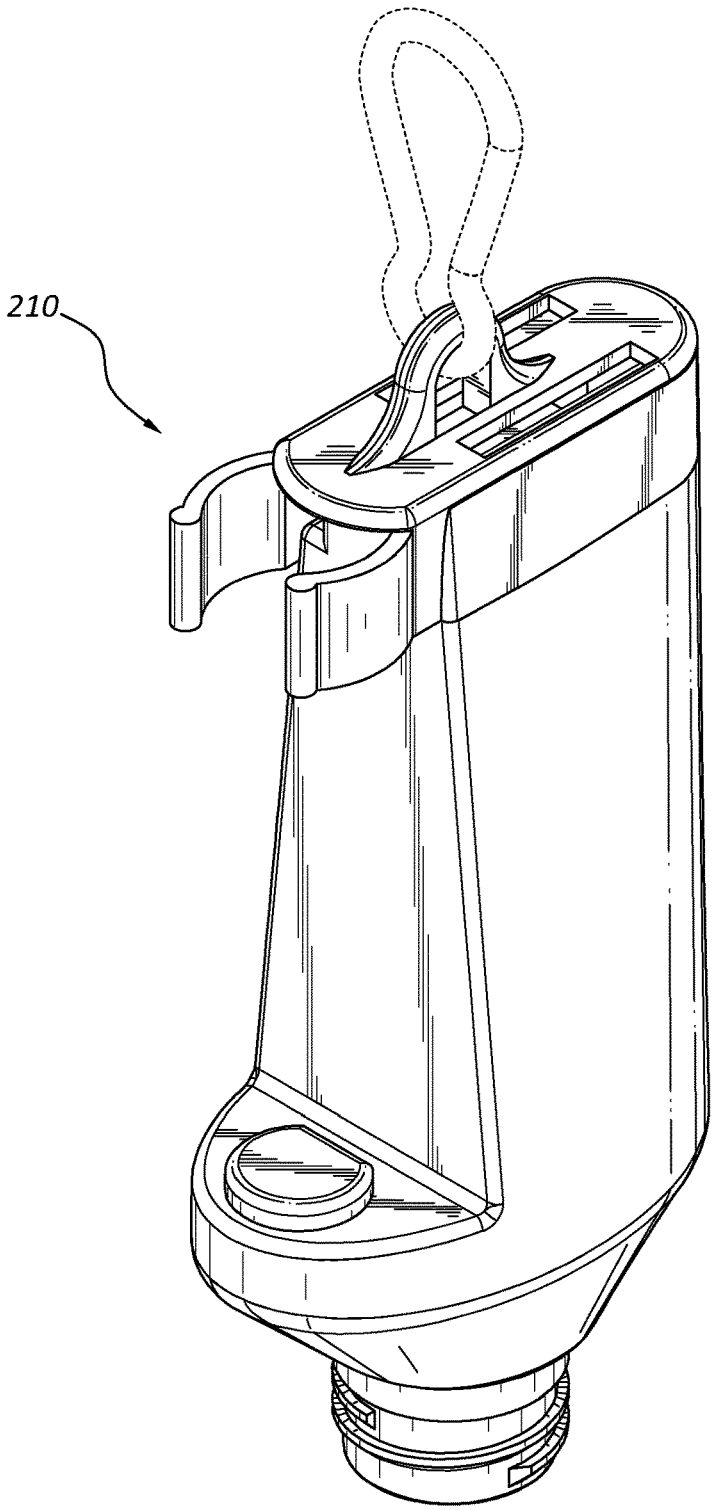
FIGS. 20 and 21 are perspective views of the Bottle Assembly of FIG. 15 without the lid of the bottle.
Figure 21:
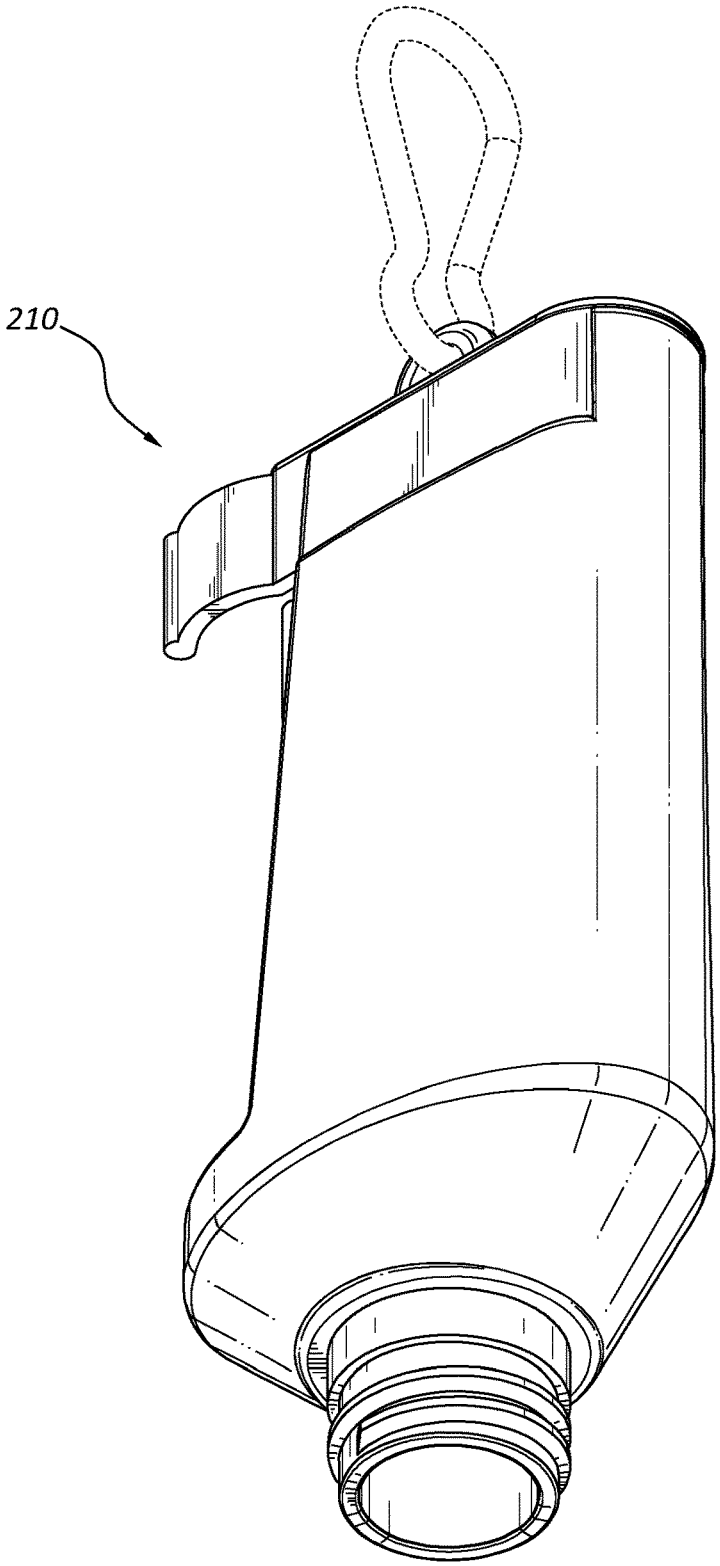
Figure 22:
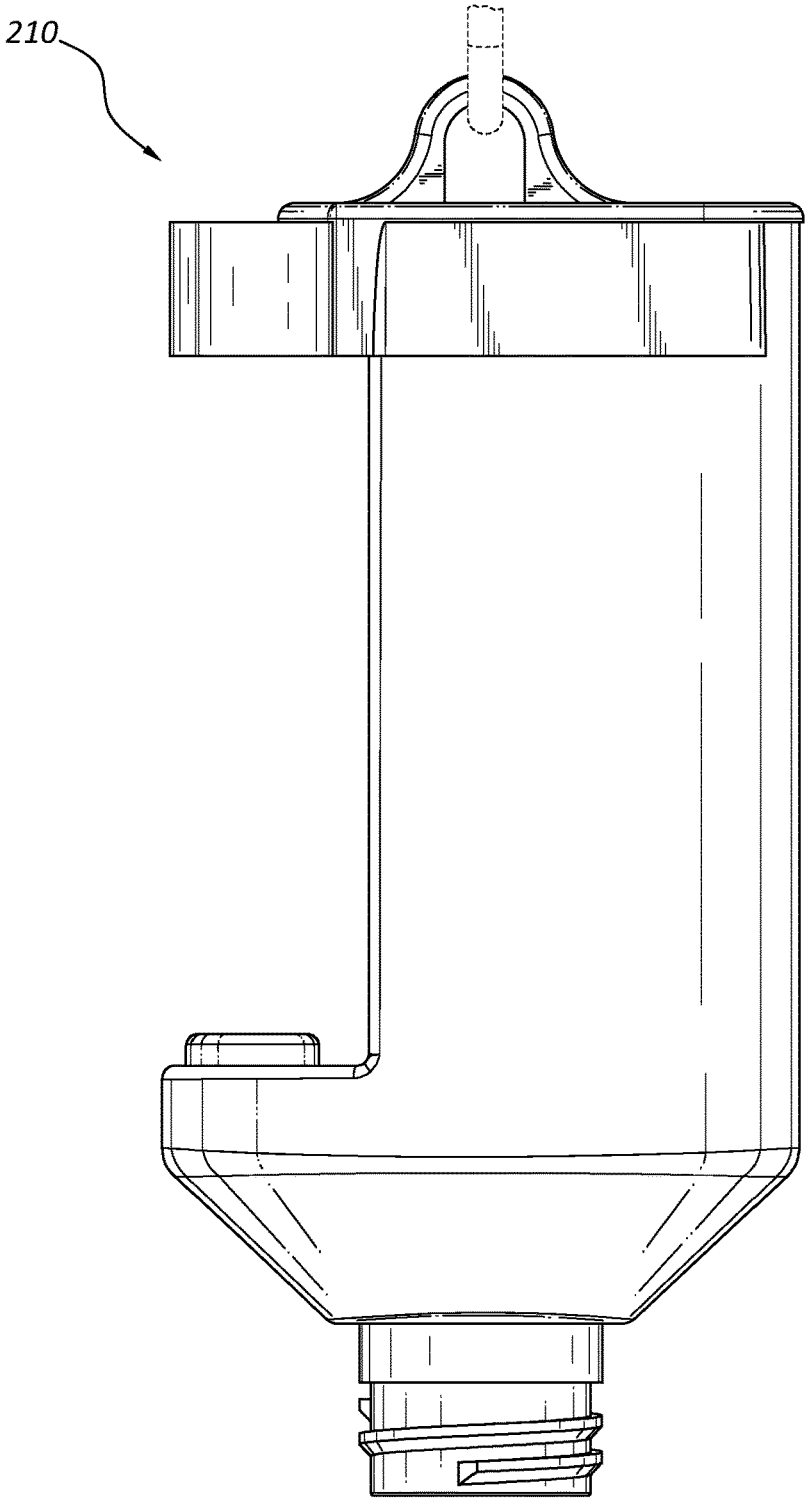
FIGS. 22 and 23 are respective right and left side views of the combined coupling assembly and bottle (without lid) of FIGS. 20-21.
Figure 23:
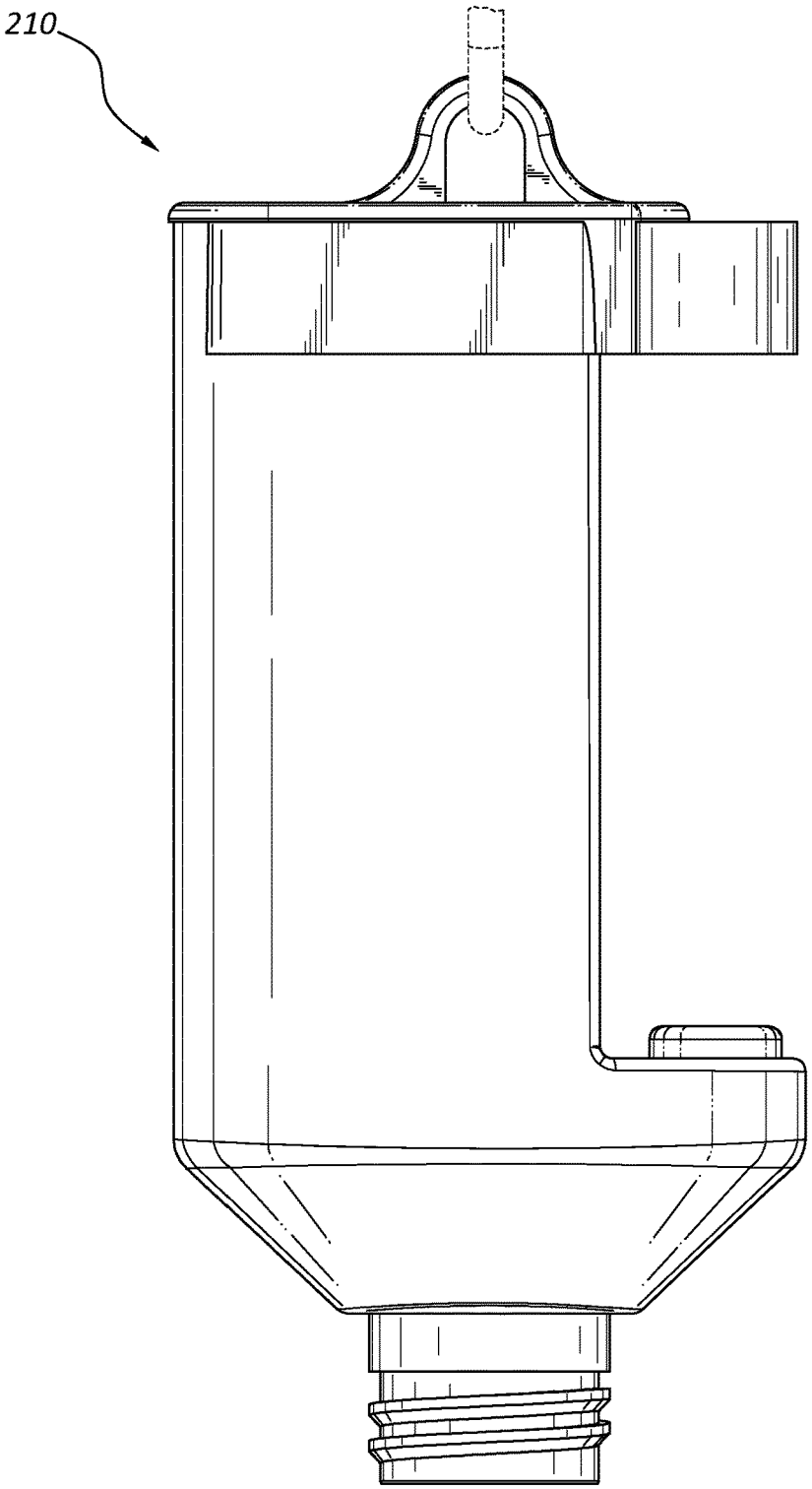
Figure 24:
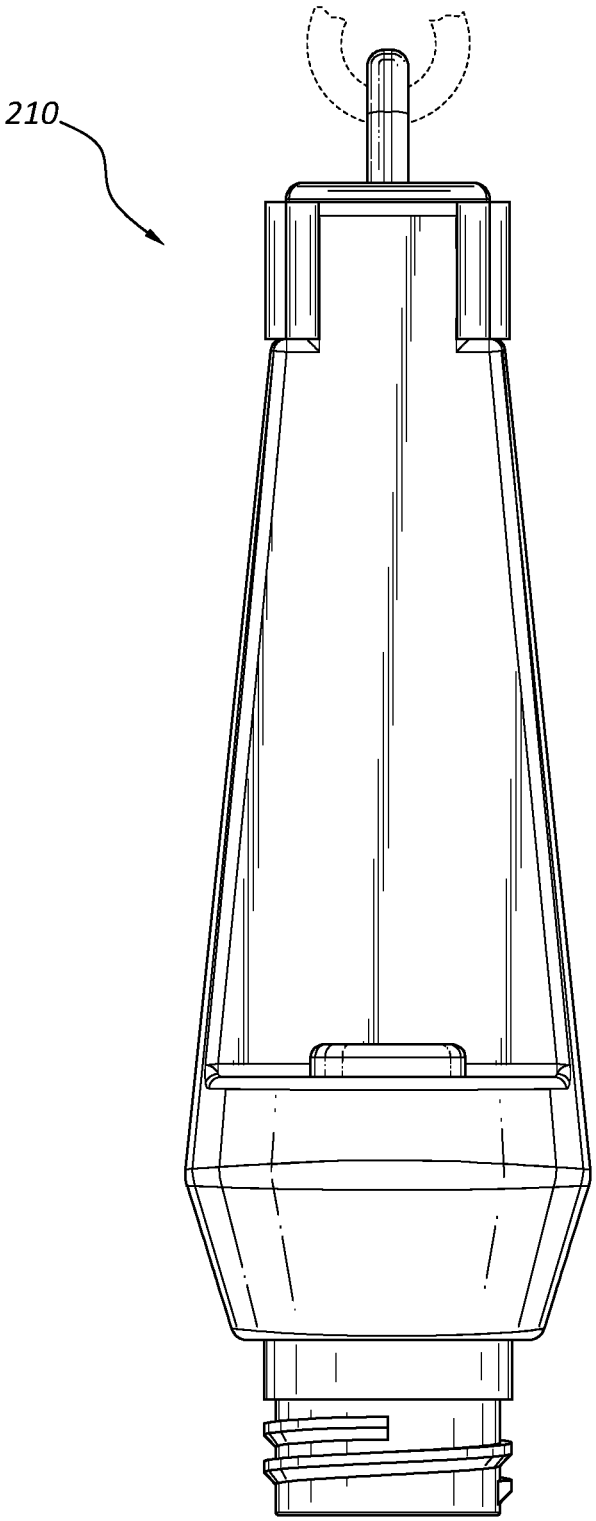
FIGS. 24 and 25 are front and back views, respectively, of the combined coupling assembly and bottle of the FIGS. 20-21.
Figure 25:
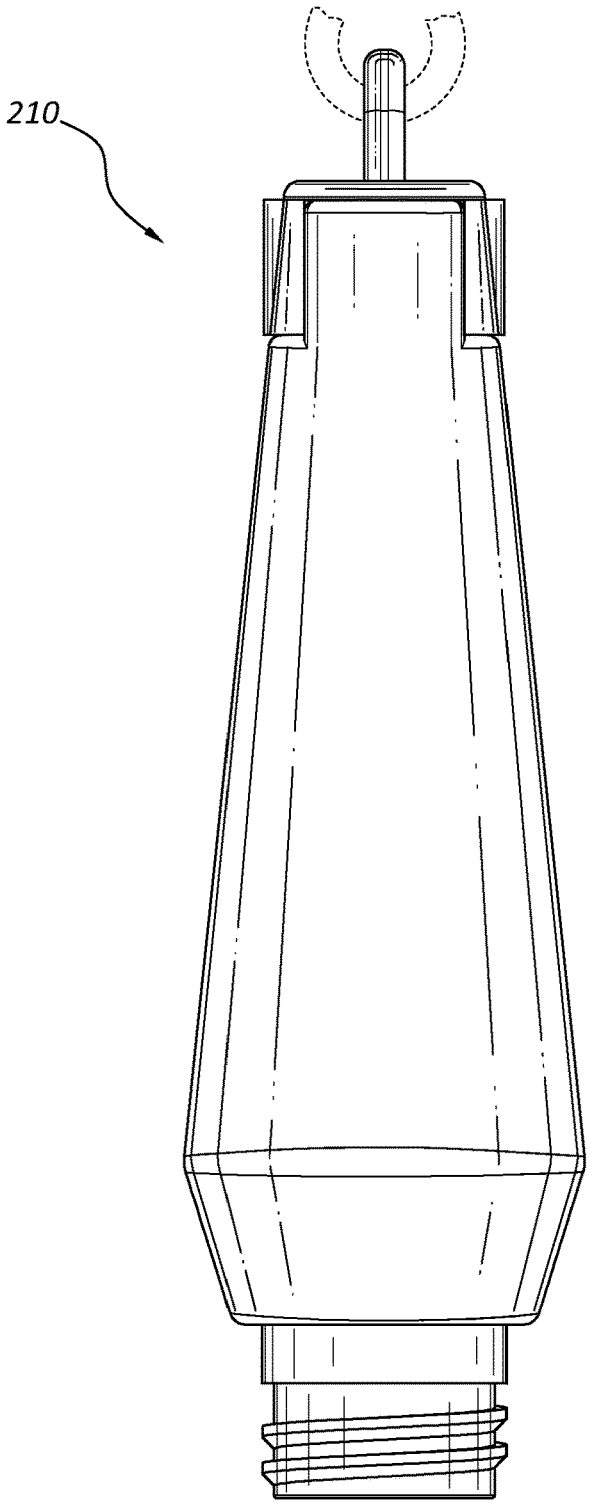
Figure 26:
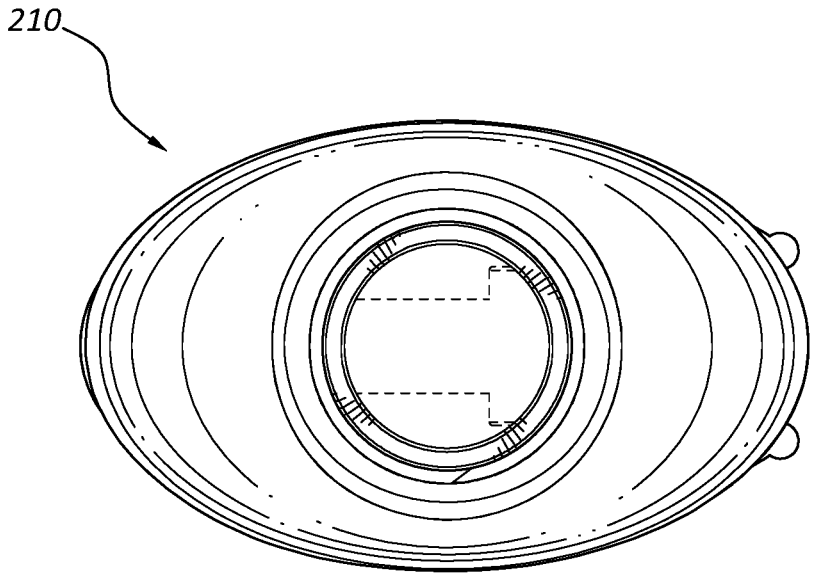
FIGS. 26-27 are respective bottom and top views of the combined coupling assembly and bottle of FIGS. 20-21.
Figure 27:
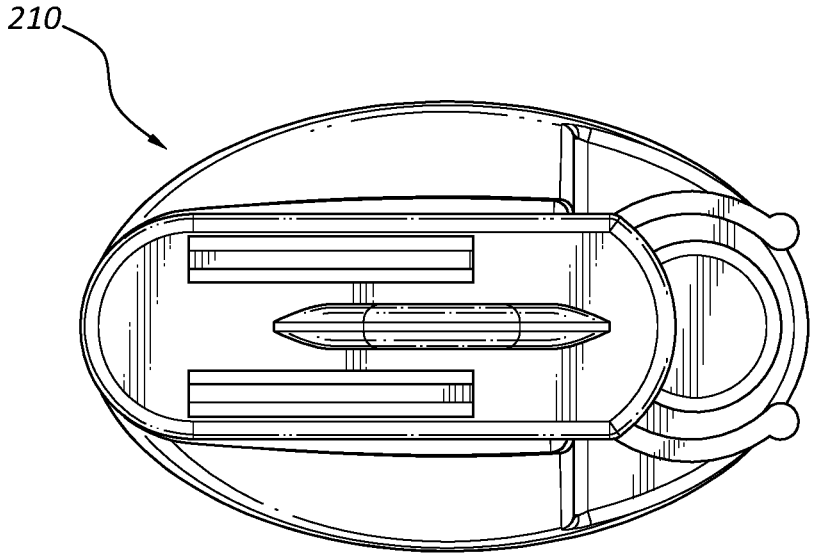
Figure 28:
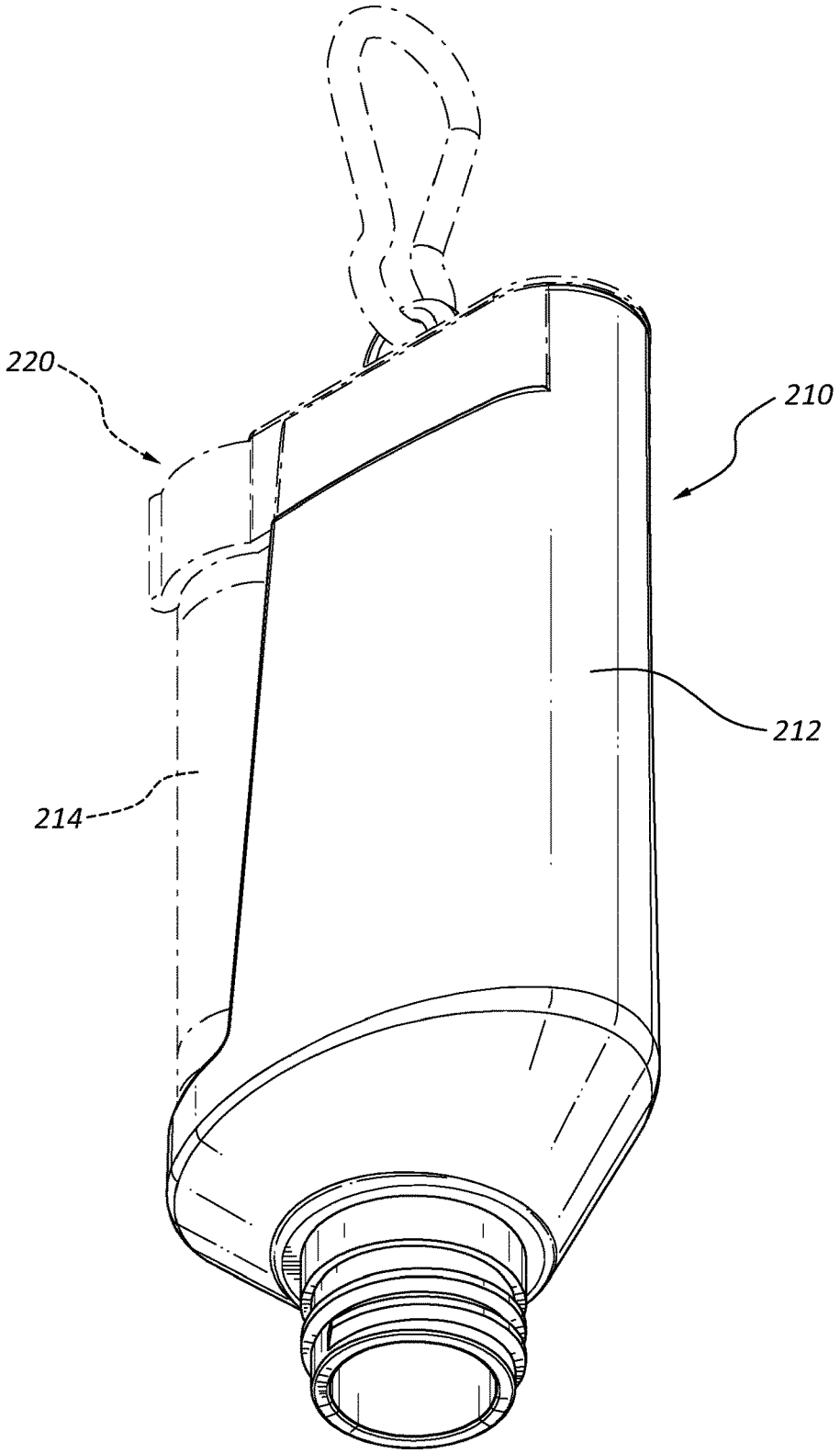
FIG. 28 is a perspective view of the Bottle Assembly of FIG. 15 without the cap on the bottle of the Bottle Assembly and with the lip balm container shown in broken, phantom lines.
Figure 29:
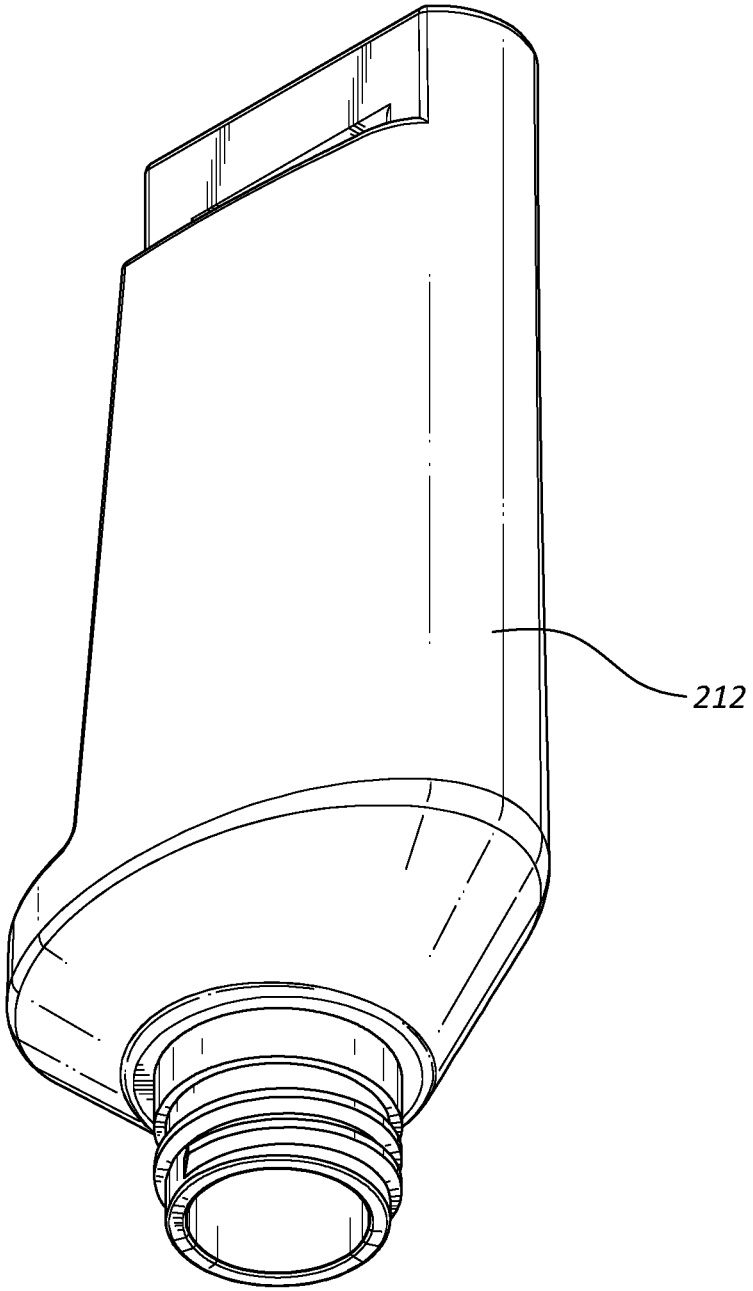
FIGS. 29 and 30 are perspective views of the bottle of the Bottle Assembly of FIG. 15 without the lid of the bottle.
Figure 30:
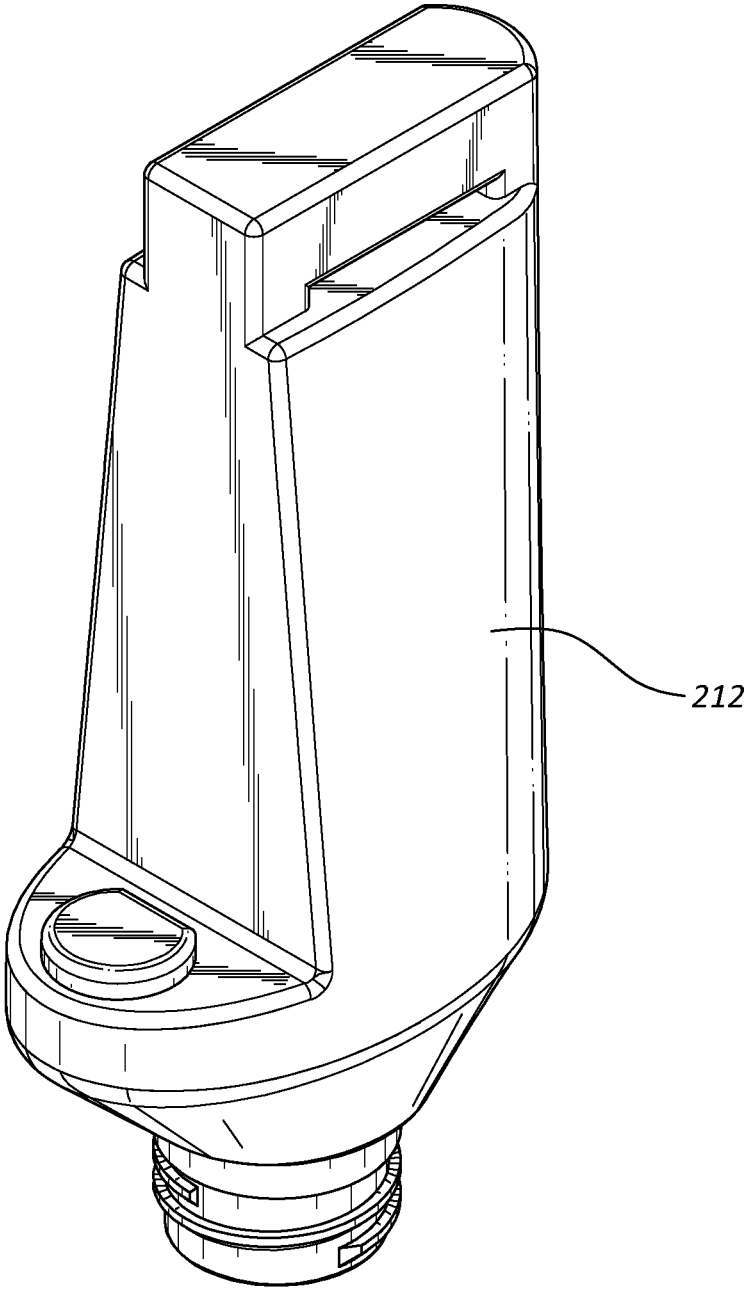
Figure 31:
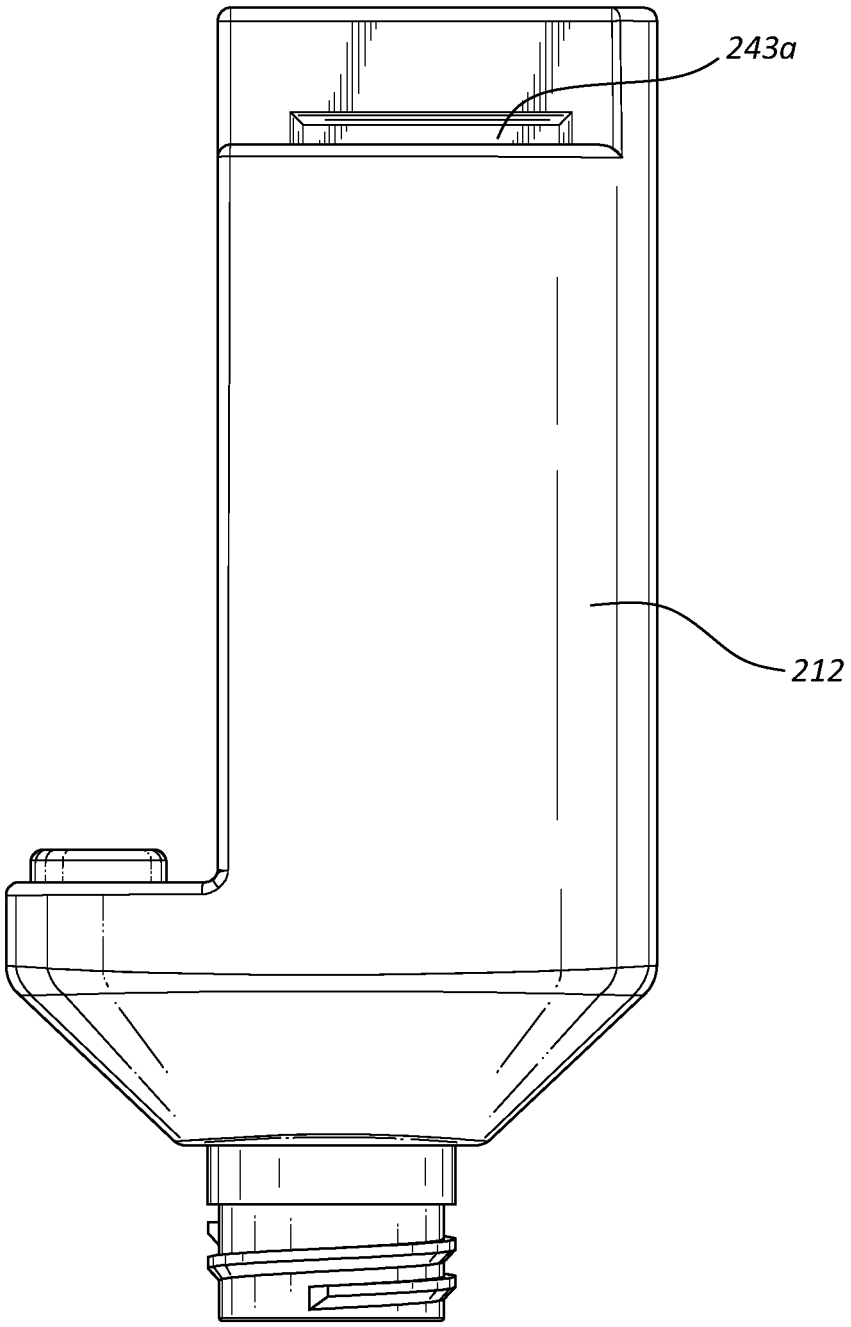
FIGS. 31 and 32 are respective right and left side views of the bottle of FIGS. 29 and 30.
Figure 32:
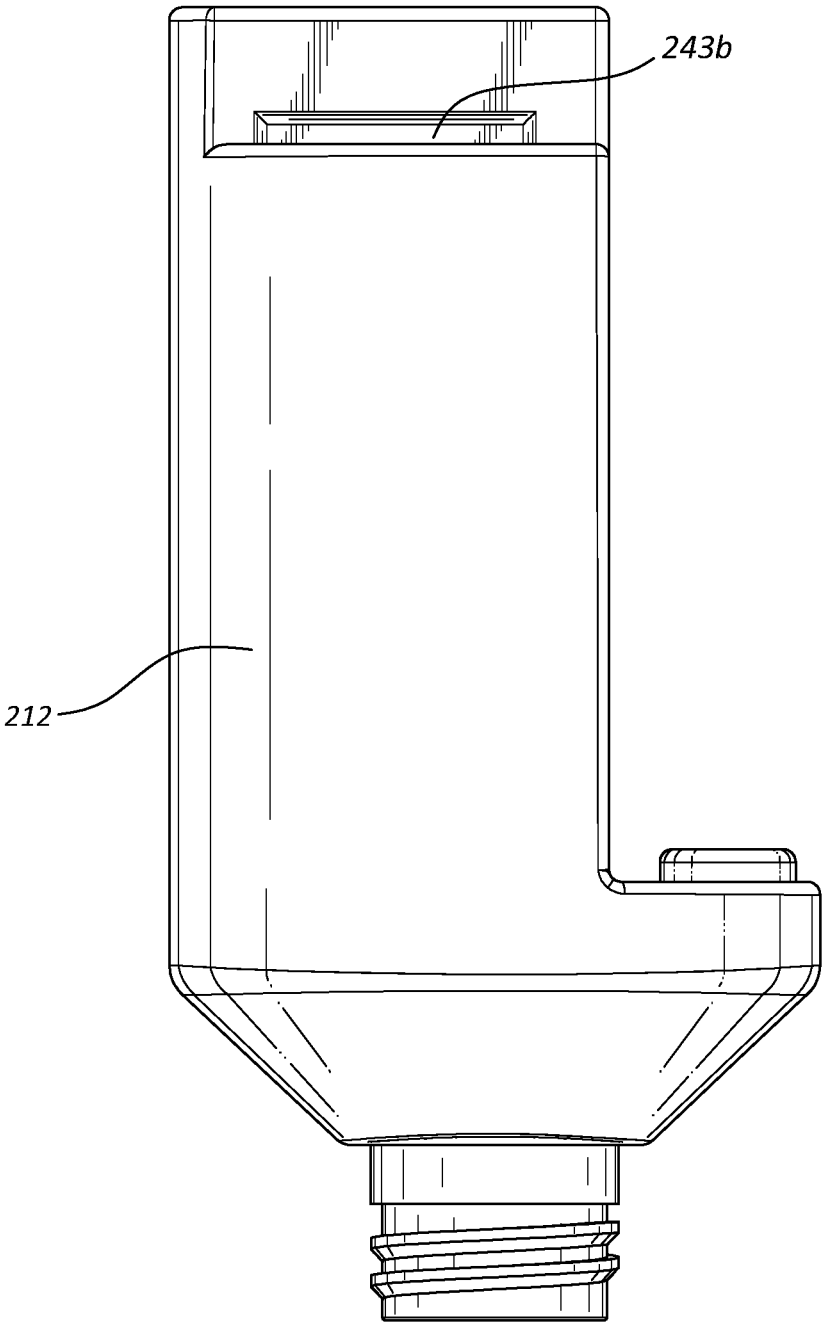
Figure 33:
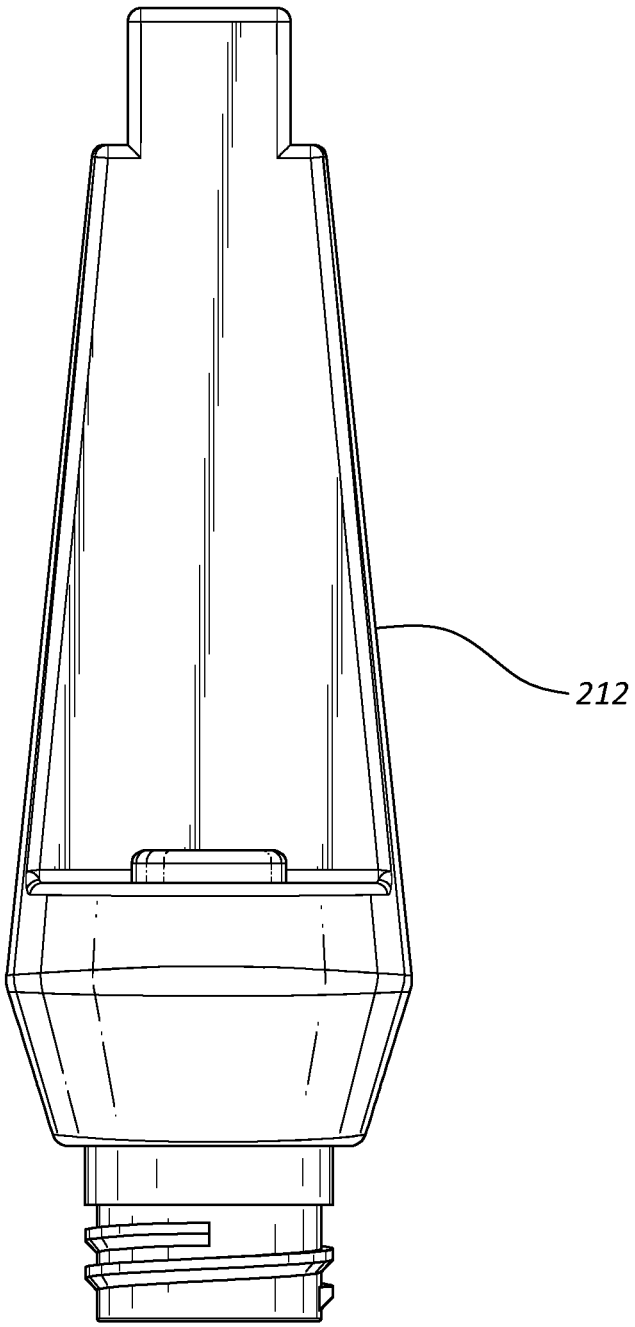
FIGS. 33 and 34 are front and back views, respectively, of the bottle of FIGS. 29 and 30.
Figure 34:
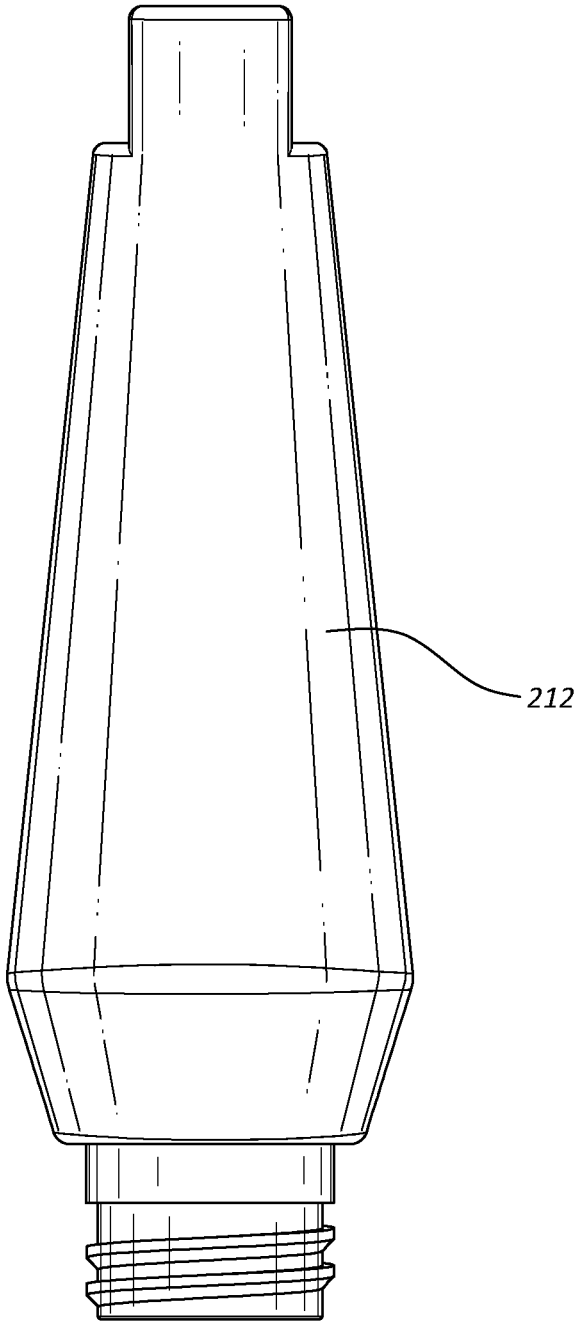
Figure 35:
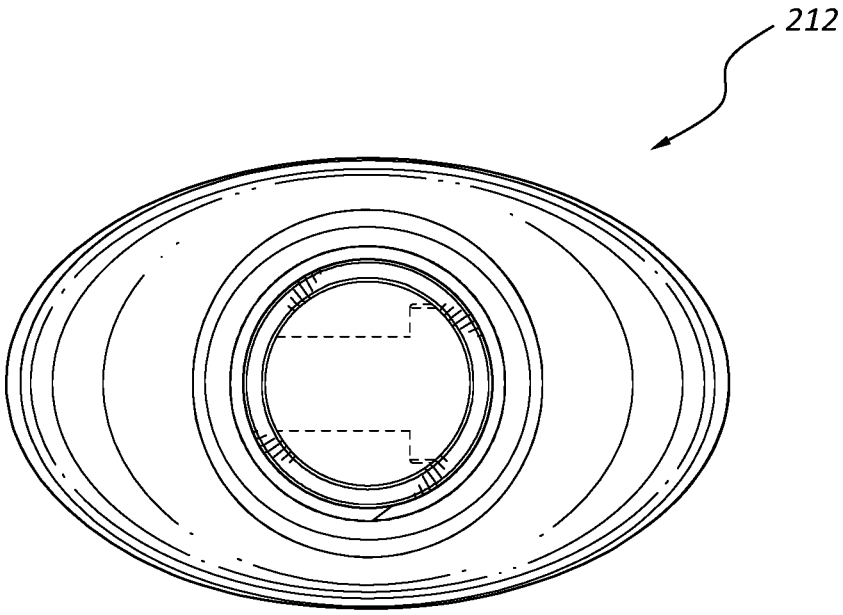
FIGS. 35-36 are respective bottom and top views of the bottle of FIGS. 29 and 30.
Figure 36:
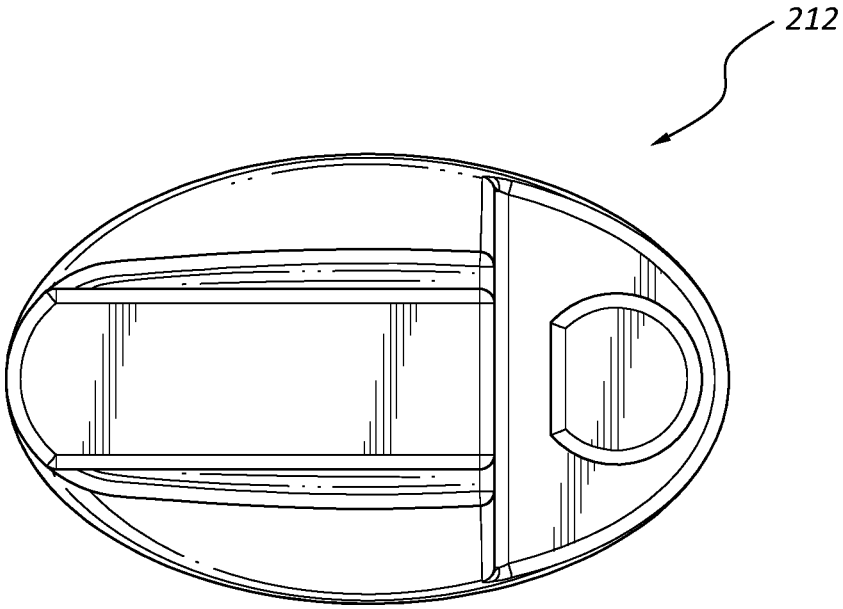

Bottle assembly 210 further comprises a cap 260 mounted on bottle 212 for releasably maintaining a liquid such as sunscreen within bottle 212. Lip balm container 214 comprises lip balm container body 262 and lip balm container cap 266 and a rotating lip balm container adjustment device 265 for adjustably moving the lip balm within container body 262. Elongate lip balm container 214 contains a lip balm or other medicinal or soothing material therein. Body 262 of elongate container 214 may have a concave lower surface configured to receive protuberance 266 therein to assist with maintaining lip balm container within compartment 218 when an upper portion of lip balm container 214 is removably mounted within coupling assembly 219, as shown in FIG. 15. As shown in FIG. 19, the lower ledge 230 of the assembly 210 includes rounded, convex protuberance 266 extending upwardly from the ledge 230.

The resiliently movable clasping latches 246, 248 of coupling assembly 219 are available for a lip balm container 214 to be removably placed therebetween, such that the clasping latches 246, 248 will temporarily move apart as the lip balm container is placed there between, but then will resiliently maintain lip balm container 214 therebetween when lip balm container 214 is placed on the rounded protuberance 266 and between ledges 222 and 224. Container 214 may then be selectively removed from latches 246, 248.

Coupling assembly 219 may be a single molded plastic piece that snaps onto opposing sides of body 226 of bottle 212 (e.g., a plastic bottle 212). Panels 242*a*-*b* are comprised of respective elongate walls which are sufficiently deformable to be mounted on body 226 of body 212 during assembly. Latches 248, 246 extend from respective panels 242*a*-*b* such that respective distal curved latches 248, 246 extend outwardly with sufficient resilient deformability so they can be moved apart to receive lip balm container 214 therein, yet with sufficient resilience that they will move back into place once the lip balm container 214 is grasped between latches 246, 248. Latches 246, 248 can then be moved apart again when container 214 is pulled away from latches 246, 248.

In use, the user conveniently mounts the lip balm container 214 onto protuberance 266 of ledge 230 when it is desired to place the lip balm container 214 within bottle 212 and further snaps lip balm container 214 between curved latches 246, 248 of coupling assembly 219. In this position, the lip balm container and the sunscreen or other liquid in bottle 212 can be conveniently moved, stored and maintained in a singular assembly, such that the user will have both at the user's ready disposal when needed and such that the user will not need to remember to obtain separate lip balm and sunscreen in distinct locations when needed.

When the user desires to use sunscreen, the user can maintain both in an assembly and apply the sunscreen by opening the lid of cap 260, or by removing cap 260, and dispensing sunscreen from bottle 212. When the user desires to apply lip balm, the user can remove lip balm container 214 from the grasp of curved latches 246, 248 and readily apply the lip balm from container 214, then return the lip balm container 214 to the position illustrated in FIG. 16.

In one embodiment, the lip balm container 214 is configured to fit within the outer wall of bottle 212 such that container 214 substantially fits within the horizontal footprint of the bottle 212. By fitting within the horizontal footprint of bottle 212, lip balm container 214 efficiently uses space within the profile of bottle 212. Assembly is thus a convenient bottle assembly for storing a liquid material and a balm material in separate portions of the assembly 210 for convenient storage of the materials without co-mingling the materials.

The bottle body 226 has extensive space for printing logos and other promotional material because the grasping assembly 219 is mounted on the top edge of the bottle 212, not in the middle of the bottle 212. The grasping assembly 219 also plays both roles of providing a hook location for a carabiner as well as providing grasping latches 246-248, as well as providing a partial top ceiling.

Other views of the bottle assembly of the present invention are shown in the parent Design Application Ser. No. 29/498,657 which is incorporated herein by reference.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A bottle assembly for storing a liquid material and a balm material in separate portions of the assembly for convenient storage of the materials without co-mingling the materials, the bottle assembly comprising:

a bottle having a lower ledge extending from a wall thereof; and a coupling assembly mounted to the bottle for removably coupling a container to the bottle, the coupling assembly having an upper ledge and a substantially planar body having opposing side panels extending downwardly therefrom, the side panels having ridges thereon for mounting into a body of the bottle, such that a container is selectively mounted between the lower ledge of the bottle and the upper ledge of the coupling assembly.

2. A bottle assembly as recited in claim 1, wherein the coupling assembly further comprising a connecting member for mounting a carabiner on the coupling assembly, such that the bottle assembly can be selectively coupled to a belt loop or other object.

3. A bottle assembly as recited in claim 1, wherein the substantially planar body terminates in the upper ledge.

4. A bottle assembly as recited in claim 3, wherein the coupling assembly is mounted on an upper edge of the bottle body.

5. A bottle assembly as recited in claim 1, wherein the bottle has a recessed end wall having an L-shaped compartment for receiving a lip balm container and wherein the coupling assembly comprises grasping latches that removably grasp the lip balm container as the lip balm container rests on a protuberance within the L-shaped compartment the bottle further comprising a connecting ring for mounting a carabiner on the grasping assembly.

6. A bottle assembly as recited in claim 1, wherein the upper ledge maintains an upper partial lid on the lip balm container in the upright position and acts as a lower ledge upon which lip balm container partially rests an inverted position, such that the ledge acts in both the upright and inverted positions to maintain the container coupled to the bottle.

7. A bottle assembly as recited in claim 1, wherein a connecting ring, gripping latches, and ledge are combined within the coupling assembly, which is conveniently mounted onto the bottle during the manufacturing process.

8. A container as recited in claim 1, wherein the bottle comprises a sunscreen bottle.

9. A container as recited in claim 1, wherein the container comprises an elongate lip balm container.

10. A container as recited in claim 1, wherein the coupling assembly has a connecting member in the form of a connecting ring for receiving a carabiner.

11. A container as recited in claim 1, wherein the bottle has a rounded protuberance upon which the container is mounted.

12. A container as recited in claim 1, wherein the coupling assembly is configured to couple over an end of a lip balm container to the bottle while another end of the lip balm container rests on a protuberance of a ledge of the bottle.

13. A bottle assembly configured to maintain two different materials within different portions of the bottle assembly for selective use by a user, the bottle assembly comprising:

a bottle;

a coupling assembly mounted to the bottle for removably grasping a container as the container rests within a substantially U-shaped compartment formed by the coupling assembly and the bottle, wherein the coupling assembly comprises a substantially planar body having opposing side panels extending downwardly therefrom, the side panels having ridges thereon for mounting into a body of the bottle.

14. A bottle assembly as recited in claim 13, wherein the coupling assembly is configured with an upper ledge to enable a user to selectively insert the container into the compartment formed by an end wall of the bottle, the upper ledge of the coupling assembly and a lower ledge of the bottle.

15. An assembly as recited in claim 13, wherein the elongate container substantially fits within the horizontal footprint of the bottle.

16. An assembly as recited in claim 13, wherein the bottle comprises a bottle body having a recessed wall having a ledge, the elongate container fitting within the compartment between the bottle ledge and the ledge of the coupling assembly.

17. A method for providing an assembly for storing two different materials, the method comprising:

providing a bottle having an end wall and a ledge extending from the end wall;

providing a coupling assembly for removably grasping a container as the container rests on the ledge, the coupling assembly configured with a ledge and a substantially planar body having opposing side panels extending downwardly therefrom, the side panels having ridges thereon for mounting into a body of the bottle, the bottle end wall, bottle ledge, and coupling assembly ledge forming a subtantially U-shaped compartment, the compartment enabling a user to selectively insert container into the compartment and to selectively remove container from the compartment;

providing a separate container configured to fit within the substantially U-shaped compartment; and placing the container within the substantially U-shaped compartment such that the container is conveniently coupled to the bottle within the compartment and can be selectively removed therefrom.

18. A method as recited in claim 17 wherein the bottle is configured to hold a liquid material, and wherein the container is configured to hold a lip balm material therein.

19. A method as recited in claim 18, wherein the coupling assembly has a connecting member thereon.

* * * * *